US005365723A

United States Patent [19]

Ramos

[11] Patent Number: 5,365,723

[45] Date of Patent: Nov. 22, 1994

[54] PORTABLE BAGGAGE WRAPPING APPARATUS

[76] Inventor: Enrique A. Ramos, 5104 Charles St., Omaha, Nebr. 68132

[21] Appl. No.: 948,483

[22] Filed: Sep. 21, 1992

Related U.S. Application Data

[63] Continuation-in-part of Ser. No. 685,736, Apr. 16, 1991, abandoned.

[51] Int. Cl.[5] ..... B65B 11/04

[52] U.S. Cl. ..... 53/556; 53/66; 53/74; 53/587; 53/592; 53/211

[58] Field of Search ..... 269/254 CS; 279/110, 279/133; 53/211, 213, 441, 556, 587, 588, 592, 74, 399, 64, 66

[56] References Cited

U.S. PATENT DOCUMENTS

| | | | |
|---|---|---|---|
| 1,339,808 | 5/1920 | Chamberlin | 53/213 |
| 1,840,222 | 1/1932 | Brown | 53/211 X |
| 2,608,810 | 9/1952 | Smathers | 53/213 |
| 3,514,920 | 6/1970 | Hoffler et al. | 53/64 |
| 3,815,313 | 7/1974 | Heisler . | |
| 4,204,377 | 5/1980 | Lancaster et al. | 53/394 |
| 4,216,640 | 8/1980 | Kaufman | 53/556 |
| 4,248,031 | 2/1981 | Del Pozo, Jr. | 53/556 |
| 4,283,903 | 8/1981 | Mayhall et al. | 53/587 |
| 4,299,076 | 11/1981 | Humphrey | 53/211 X |
| 4,458,467 | 7/1984 | Shulman et al. | 53/441 X |
| 4,468,915 | 9/1984 | Parry | 53/587 |
| 4,497,159 | 2/1985 | Lancaster, III | 53/399 X |
| 4,502,264 | 3/1985 | Flaherty | 53/441 X |
| 4,514,955 | 5/1985 | Mouser et al. | 53/64 |
| 4,515,195 | 5/1985 | Gladstein | 269/254 CS X |
| 4,546,593 | 10/1985 | Lasscock | 53/441 |
| 4,563,863 | 1/1986 | Humphrey | 53/587 X |
| 4,593,517 | 6/1986 | Mattila | 53/441 |
| 4,628,667 | 12/1986 | Humphrey et al. | 53/441 X |
| 4,693,049 | 9/1987 | Humphrey . | |
| 4,706,443 | 11/1987 | Humphrey | 53/556 |
| 4,747,252 | 5/1988 | Kapke | 53/441 X |
| 4,754,594 | 7/1988 | Lancaster | 53/441 X |
| 4,852,331 | 8/1989 | Bogh | 53/399 |
| 4,912,911 | 4/1990 | Down | 53/64 X |
| 4,949,533 | 8/1990 | Bate | 53/556 |
| 4,955,181 | 9/1990 | Casteel | 53/556 |
| 5,005,335 | 4/1991 | Yourgalite et al. | 53/399 |
| 5,168,691 | 12/1992 | Errani | 53/587 |

FOREIGN PATENT DOCUMENTS

| | | | |
|---|---|---|---|
| 0178145 | 4/1986 | European Pat. Off. | 53/556 |
| 0037317 | 2/1989 | Japan | 53/556 |

*Primary Examiner*—John Sipos
*Assistant Examiner*—Daniel Moon
*Attorney, Agent, or Firm*—John A. Beehner

[57] ABSTRACT

A baggage protection device wherein the device consists of a base carriage onto which is mounted a turntable with a securing device. Also mounted on the base carriage is a roll of stretch-wrap plastic film, along with feeder posts and a vertical frame. An alternative embodiment of the baggage protection device consists of a base carriage unit having a rear section and a front section which may be extended outwards from the rear section to accommodate larger baggage to be wrapped thereon. A turntable is mounted on the front section of the base carriage unit, the turntable having a pair of hydraulic rams which act to urge together a pair of grip tongs movably mounted on the upper surface of the turntable. Mounted atop the rear section is a roll of stretch-wrap plastic film. As the plastic film is drawn from the roll, it passes around an idler roller and around a tensioning roller, the tensioning roller and idler roller being in contact with one another. The stretch-wrap plastic film then is placed on the baggage to be wrapped, tension being provided by the tensioning roller and idler roller combination. For controlling the overall operation of the unit, a programmable controller may be provided. A piece of baggage is protected by securing it on the turntable and feeding one end of the plastic film between the feeder posts, or around the idler roller and tensioning roller, and attaching the film to the baggage. The turntable is then rotated and the baggage wrapped in stretch-wrap plastic film. The film is then divisioned and the free end of the plastic film is secured to the wrapped piece of baggage to complete the process.

19 Claims, 14 Drawing Sheets

PORTABLE BAGGAGE WRAPPING APPARATUS

CROSS-REFERENCE TO RELATED APPLICATION

This application is a continuation-in-part of U.S. patent application Ser. No. 07/685,736 filed on Apr. 16, 1991 abandoned

BACKGROUND OF THE INVENTION

1. ) Technical Field

This invention is directed to the protection of baggage, more particularly the wrapping of baggage in plastic stretch-wrap film to protect the exterior of the baggage and to prevent tampering with the contents of the same.

2.) Description of the Prior Art

Travel by airplane at first was a luxury few could afford and even fewer enjoyed. The early days of the airline industry involved antiquated ticketing methods and questionable safety measures. As the airline industry grew, however, better facilities for passengers became the norm. The advent of the movable jetway, for example, revolutionized air travel as it allowed comfortable boarding and deplaning in any weather. Safety methods became widespread, and casualties per million miles traveled dropped dramatically. The airline world learned to cater to the expectations of the passenger, and air travel became available to a greater and greater number of people every year.

And so to the present day, a time when air travel has come to be a commonplace aspect of our lives, but throughout the development of improved passenger handling methods, one thorn remained. What about the problems encountered by our travel companions, our baggage? The rate of lost, damaged, or stolen bags has continued to climb and is now at seven percent 7% of all baggage. Yet, no easy, safe, and inexpensive method of baggage protection has been invented, until now. Other forms of baggage protection involve expensive sheaths, custom-fitted for each bag, most travelers simply cannot afford. The long-term chances of the situation improving are slim, also, as baggage handlers receive low pay and have little incentive to treat baggage with care. Therefor, there is a need for an easy, safe, and inexpensive method of baggage protection, a need which the present invention addresses.

Thus, a primary object is to provide a baggage protection method which is easy, safe, and inexpensive.

Another object is to provide a baggage protection device capable of implementing the desired baggage protection method.

Yet, another object is to provide a baggage protection method and device which will not harm baggage.

Still another object is to provide a baggage protection method and device which can protect a great variety of baggage sizes and shapes.

Another object is to provide a baggage protection method and device which are fairly rapid and cause little inconvenience to travelers.

Another object is to provide a baggage protection method and device which can be quickly and easily removed upon reaching a destination.

Another object is to provide a baggage protection method and device which can save travelers time and money lost when baggage is mishandled or broken into.

Yet, another object is to provide a baggage protection method and device which can envelop a piece of luggage in several layers of plastic film, thereby protecting the baggage.

SUMMARY OF THE INVENTION

The present invention provides a method for protecting baggage by wrapping the baggage in plastic stretch-wrap film, and a device for implementing the method above. The device is designed to implement the method in a minimal period of time, to lessen inconvenience to travellers.

The device consists of a base carriage onto which is mounted a turntable. The turntable is rotated by either manual or powered means. On the turntable are a pair of grip tongs to secure the baggage on the turntable. A roll of plastic stretch-wrap film is uprightly mounted near the turntable, and the film is fed towards the turntable, through a pair of feeder posts mounted adjacent to the roll of plastic. The roll of plastic and feeder posts are mounted on a platform which can raise or lower both of the above, so that as a tall piece of baggage is being wrapped, the plastic roll moves upwards to wrap the upper portion of the baggage. At the rear of the carriage, an upright frame is mounted which holds spare rolls of plastic, handles for pushing the carriage, and the control buttons for the turntable and the plastic roll elevator.

The method for protecting a piece of baggage is as follows: First, a piece of baggage is placed on the turntable between the grip tongs. The grip tongs squeeze together, holding the baggage on the turntable. Next, the outer end of the roll of plastic film is put through the feeder posts and attached to the baggage. The turntable is then rotated, wrapping the baggage in the stretch-wrap plastic film. As the baggage is being wrapped, tension is kept on the roll of plastic to stretch the plastic film and wrap the baggage more tightly. After 2 or 3 rotations, the turntable is stopped and the plastic film is divided, either by a cutting device mounted next to the feeder posts, or by a hand-held cutting device used by the operator. During rotation and wrapping of tall baggage, however the platform holding the plastic roll and the feeder posts is elevated, thus wrapping the entire height of the baggage. This works well for baggage such as skis and golf clubs, for example. The baggage is then lifted off the turntable, and the device is ready to accommodate the next piece.

An alternative embodiment of the device consists of a base carriage unit which is comprised of front and rear sections. The front section of the base carriage is extendably connected to the rear section such that the front section may be extended forward from the rear section to accommodate oversize luggage for wrapping.

Yet another alternative embodiment consists of the present invention further including a cutting means comprised of a hot wire cutter for divisioning the moisture-impervious sheet material. The cutting means is mounted on a pivot such that the cutting means may pivot between an operating position and a standby position.

As is readily seen from the previous description, this method of baggage protection and accompanying device is easy, safe and inexpensive, and will result in almost no delays for a traveller. The service provides the best combination at present of cost-effectiveness and ease, and can be used with almost any type of baggage.

DESCRIPTION OF THE PREFERRED EMBODIMENT

Figure 1:
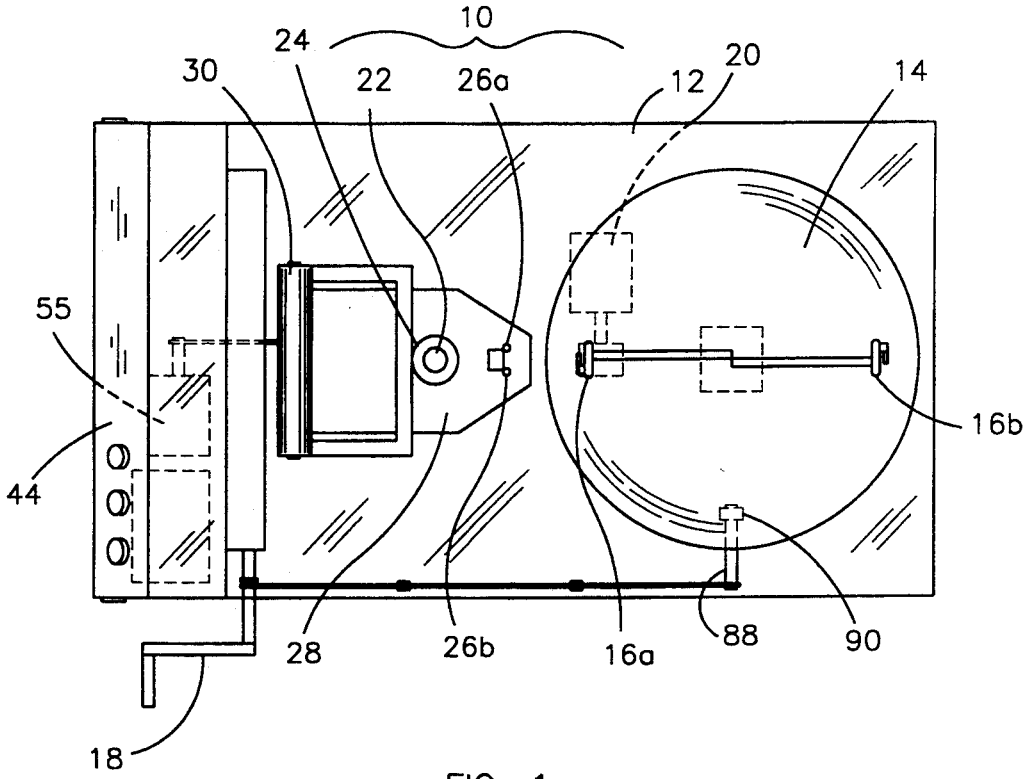
FIG. 1 is a top plan view of the baggage protection device showing the layout of the elements of the device on the carriage.

The baggage protection device 10 is shown in its preferred embodiment in FIGS. 1–4 as including a rectangular base carriage unit 12 onto which is mounted the actual workings of the device. Dimensions are not a vital element of the present invention, and the dimensions given in the following are illustrative of only one embodiment. The base carriage unit 12 has dimensions of 3 feet by 4 feet.

A turntable 14, which is approximately 24" in diameter, is mounted preferably towards the front of the carriage 12 over the center longitudinal axis of the carriage 12, and in such a way as to allow rotational motion of the turntable 14 about a generally upright axis. Movably mounted on the turntable are a pair of grip tongs, **16*a* and 16*b*, which are approximately 24" tall, which are used to secure baggage on the turntable 14. There are two ways in the preferred embodiment for the turntable 14 to be rotated. The first is by rotation of a manual crank 18 which rotates the turntable by a gearing means. The second is by engagement of an electric motor which is attached through a gearing means to the center of the turntable 14**.

Rearward of the turntable 14, a spindle 22, approximately 33" tall, is mounted uprightly to accommodate a roll of stretch-wrap plastic film 24. Each roll 24 is approximately 30" in width. When the roll 24 is placed on the spindle 22, plastic can be unrolled as the spindle 22 allows rotation of the roll 24. Mounted in between the spindle 22 and the turntable 14 are a pair of feeder posts **26*a* and 26*b*, which are approximately 35" in height, between which the unrolling plastic 25 is guided. In the preferred embodiment, the spindle 22 and the feeder posts 26*a* and 26*b* are mounted on a movable platform 28 which can raise or lower the two above elements by a lifting device 30**.

Figure 2:
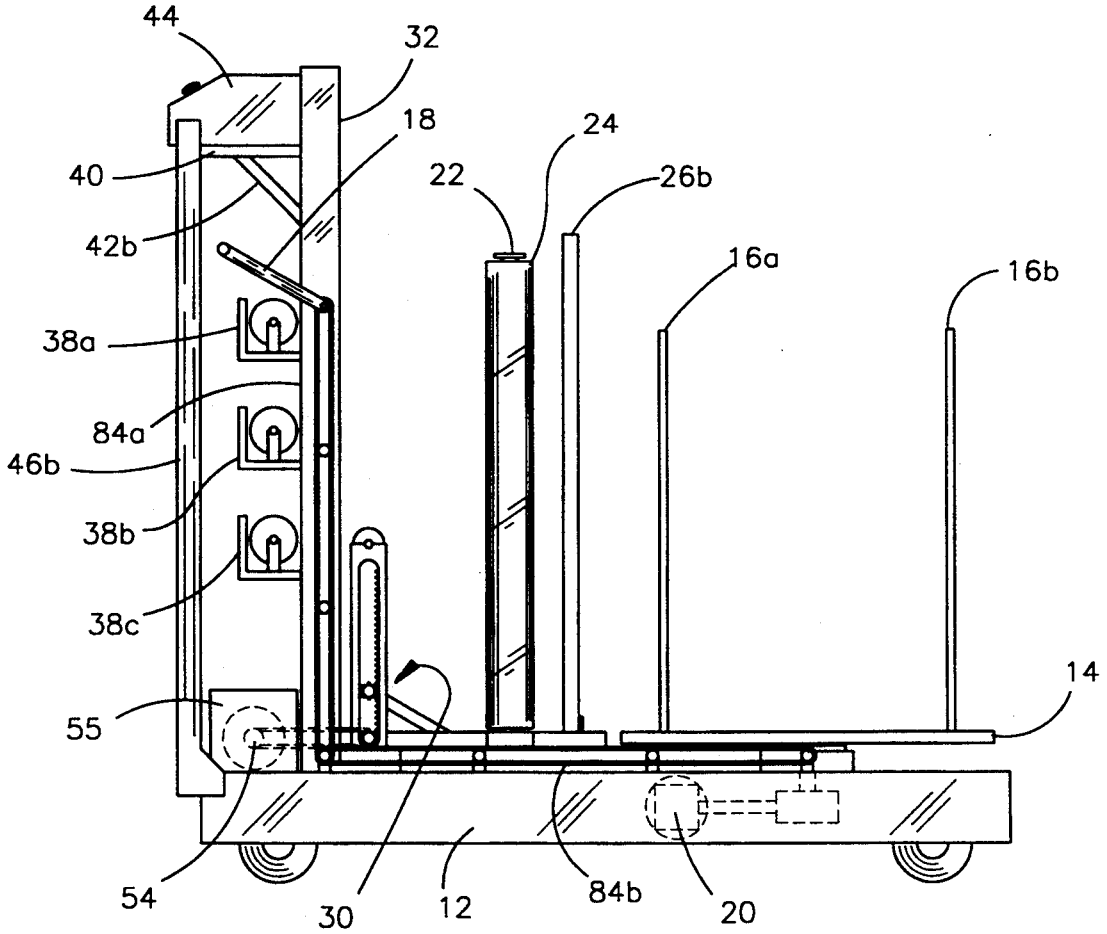
FIG. 2 is a side elevational view showing the vertical frame holding spare rolls and the elevating means for the platform holding the tensioner, the plastic roll, and the feeder posts.
Figure 3:
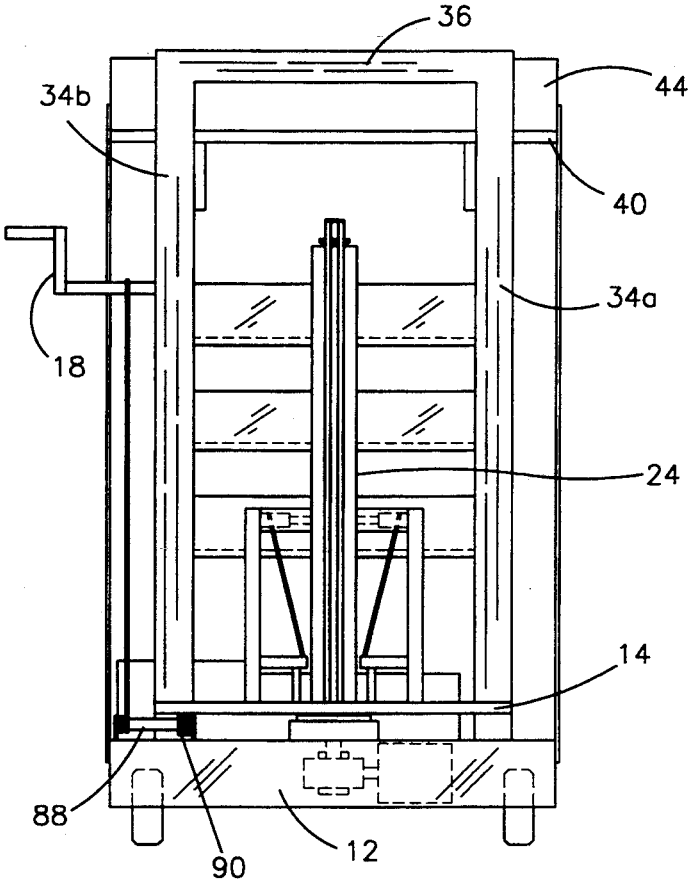
FIG. 3 is a front elevational view showing the feeder posts and the plastic roll mounted on the tensioner.
Figure 4:
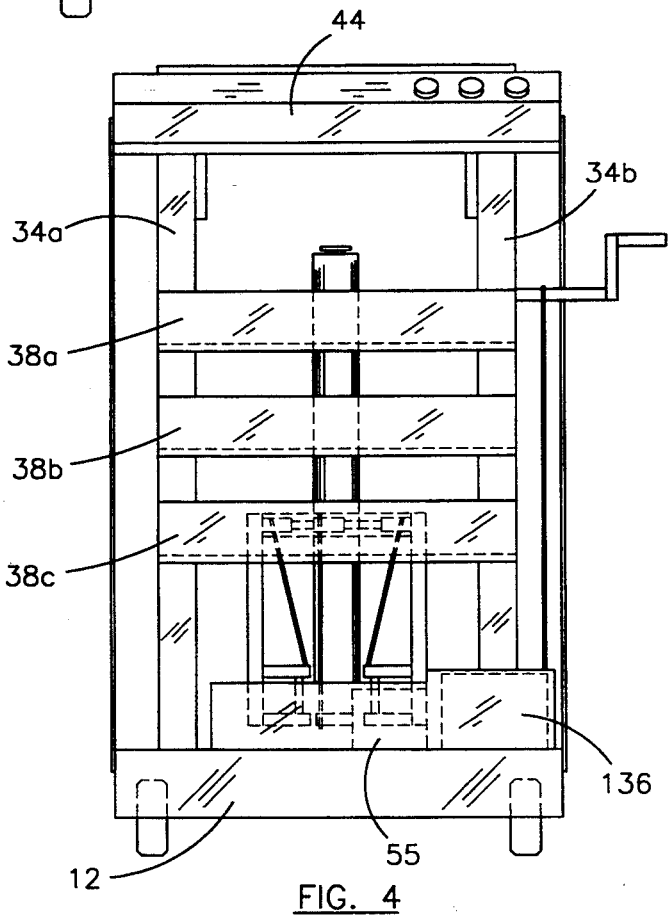
FIG. 4 is a rear elevational view showing the location of the control panel and spare roll racks.

Looking to FIG. 2, at the rear of the base carriage unit 12 in the preferred embodiment is mounted an upright frame 32, about 47" in height, onto which is rotatably mounted the manual crank 18 for rotation of the turntable 14. In the preferred embodiment, the upright frame 32 consists of two upright members 34*a* and 34*b*, which are spaced apart approximately 34". Extending between and connected to the top portion of the upright members 34*a* and 34*b* is a cross-member 36. Extending between and connected to the middle portion of the upright members 34*a* and 34*b* are one or more shelf units 38*a*, 38*b*, and 38*c*, which are designed in the preferred embodiment to carry spare rolls of plastic 24. Extending outwardly and rearwardly from the upright members 34*a* and 34*b* is a control panel shelf 40 mounted substantially parallel with the base carriage unit 12. Extending between and connected to the sides of the control panel shelf 40 and the upright members 34*a* and 34*b* are preferably a pair of control panel shelf support struts 42*a* and 42*b*. Mounted atop the control panel shelf 40 is the control panel 44. Extending between and connected to the rear of the control panel shelf 40 and the rear of the base carriage unit are a pair of handles 46*a* and 46*b* which can be used to push or pull the baggage protection device 10.

Figure 5:
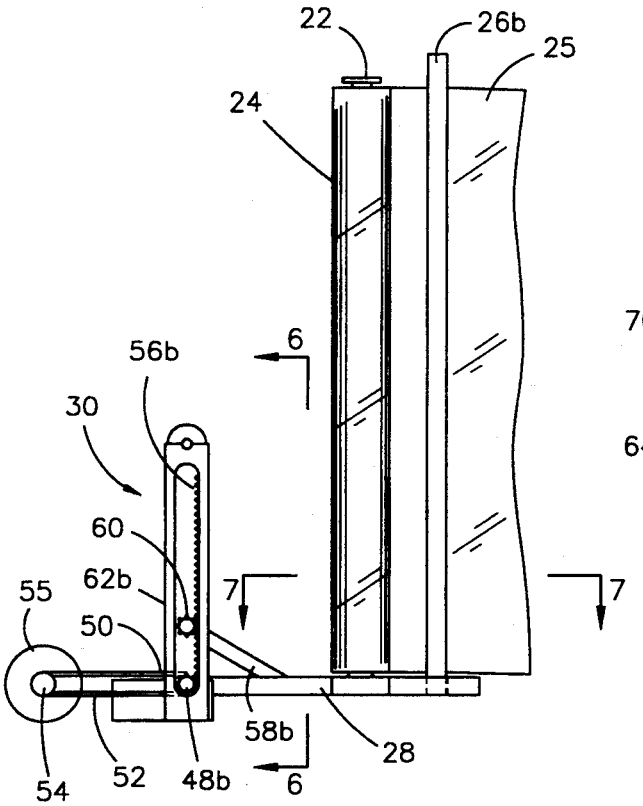
FIG. 5 is a partial detail side elevational view of the tensioner, plastic roll, and feeder posts mounted on the platform that can be raised or lowered by the elevating means also shown.

Looking to FIG. 5, a detail view of the movable platform 28 is shown, along with the spindle 22, a roll of plastic 24, and the feeder posts 26*a* and 26*b*. The lifting device 30 is shown also. The lifting device 30 consists of a pair of gears 48*a* and 48*b* rotatably mounted on an axle 50 on the movable platform 28. The gears are rotated by a closed belt loop 52 passing around and in contact with the axle 50 which leads to the rotating shaft 54 of an electric motor 55. When engaged, the rotating shaft 54 turns the belt 52 which rotates the gears 48*a* and 48*b*. The gears 48*a* and 48*b* are in a pair of substantially upright toothed tracks 56*a* and 56*b* so that as the gears 48*a* and 48*b* are rotated, the gears 48*a* and 48*b* and the axle 50 move either up or down, and thus the movable platform 28 is raised or lowered also. Extending upwards and frontwards from the movable platform are a pair of struts 58*a* and 58*b* in the preferred embodiment to the ends of which is attached another axle 60, which is generally parallel to and the above the first axle 50. To the ends of the second axle are attached gears 62*a* and 62*b* which fit within the toothed tracks 56*a* and 56*b* to provide additional support for the movable platform 28. In the preferred embodiment, the toothed tracks 56*a* and 56*b* are tall enough to allow the movable platform 28 to raise enough to wrap items such as skis and golf clubs. To lower the platform 28, the rotating shaft 54 is reversed and the above described process is reversed therewith.

Figure 6:
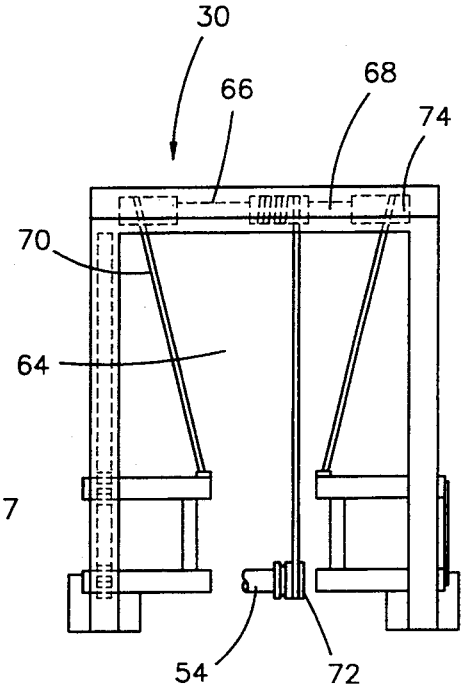
FIG. 6 is a partial detail rear sectional view of an alternative design for raising and lowering the platform as seen on line 6—6 in FIG. 5.

In FIG. 6 an alternate form of lifting device 30 is shown. It employs the same gear and toothed track setup as shown in FIG. 5, however, the lifting device 30 in this version consists of the rotating shaft 54 of an electric motor 55 attached to a pulley system 64. Extending between and connected to the tops of the toothed tracks 56*a* and 56*b* is a member 66 which in the preferred embodiment is a section of U-shaped steel channel connected to the top with the open side of the channel facing downwards. Placed substantially parallel to and within the channel and rotatably connected to both ends of the channel is an axle 68 to which, in the preferred embodiment, 70, 72, and 74, three cables, are attached. Cable 72 is attached at the approximate center of the axle 68, and the other two 70 and 74 are attached on either side of the center cable 72. Two cables 70 and 74 run downwards from the axle 68 and are attached to the forward end of the movable platform 28 in the preferred embodiment. The center cable 72 is wrapped around the axle 68 a number of times and then extends downwards and is attached to the rotating shaft 54 of an electric motor 55. As the rotating shaft 54 turns, the center cable 72 is drawn onto the shaft 54 thus causing the section of cable wrapped around the axle 68 above to unwind, thus rotating the axle 68. As the axle 68 rotates, the two outer cables 70 and 74 are wound onto the axle 68, thus drawing the movable platform 28 upwards. To lower the platform 28, the rotating shaft of the electric motor 54 is reversed, and the process follows therewith.

Figure 7:
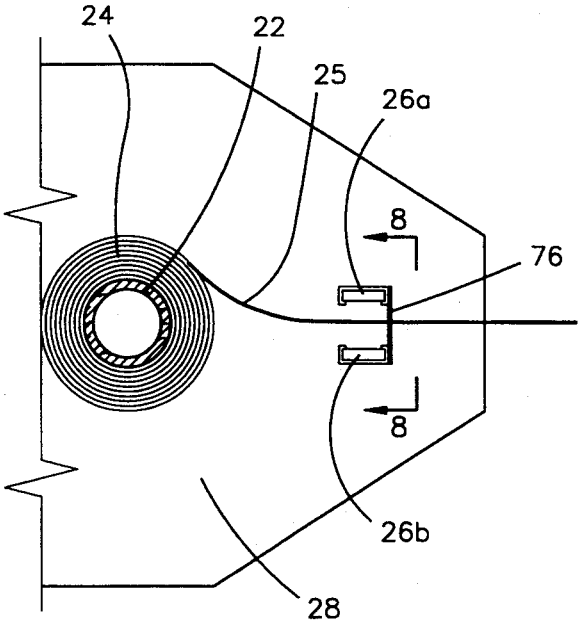
FIG. 7 is a partial detail top sectional view taken along line 7—7 in FIG. 5 showing the plastic roll mounted on the tensioner and the plastic film going between the feeder posts.

As shown best by FIG. 7, the plastic roll 24 is placed on to the spindle 22. In the preferred embodiment, the spindle 22 and plastic roll 24 are in substantial frictional contact, such that the plastic roll 24 cannot rotate unless the spindle 22 rotates. The spindle 22 is rotatably mounted on the platform 28, allowing rotation about a generally upright axis. Preferably, the spindle 22 is tensioned so that as plastic 25 is unrolled, the spindle exerts force in the opposite direction. In this way, the plastic 25 is stretched as it is wrapped about the baggage. This tensioning can be accomplished by a spring in the center of the spindle or other similar tensioning means, where one end of the spring is fastened to the platform 28 and the other to the inner surface of the spindle 22.

Also in FIG. 7 are shown the feeder posts 26*a* and 26*b* and their location in the preferred embodiment. These consist of two upright posts through which the unrolling plastic 25 is fed.

Figure 8:
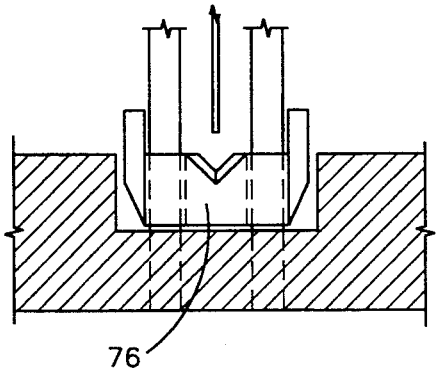
FIG. 8 is an enlarged partially sectional front view of the cutting device as mounted on the feeder posts.

Shown in FIG. 8, and also by the solid black bar extending between and connected to the feeder posts 26*a* and 26*b* is a cutting device 76. In the preferred embodiment, the cutting device 76 consists of a blade movably mounted on the feeder posts 26*a* and 26*b*, so that motion up and down the feeder posts 26*a* and 26*b* is allowed. As the cutter 76 is moved up the feeder posts 26*a* and 26*b* the plastic film 25 is divisioned, whereby the baggage wrapping method can be completed.

Figure 9:
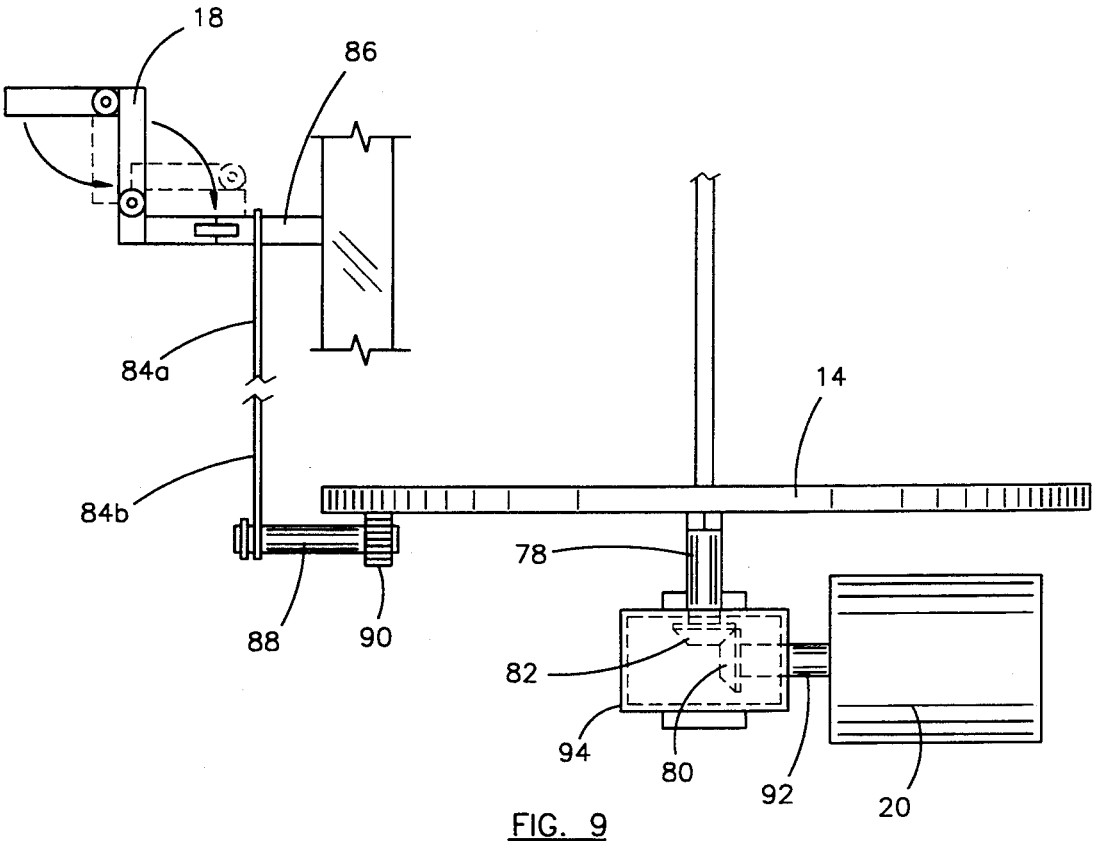
FIG. 9 is a partial detail side elevational view showing the turntable and both the manual power means, a crank, and the electrical power means, an electric motor.

FIG. 9 shows a more detailed view of the manual crank 18 means for rotating the turntable 14 and also the powered rotation means, consisting of an electric motor 20 connected to the center pivot shaft 78 of the turntable 14 through a set of intermeshing gears 80 an 82.

The manual crank 18 is rotatably mounted on the upright frame 32 in the preferred embodiment. The crank is mounted substantially perpendicular to the upright member 34*a* to which it is attached, and substantially perpendicular to the longitudinal axis of the base carriage unit 12. A series of belts 84*a* and 84*b* (shown on FIG. 2) connects the shaft of the crank 86 to another shaft 88 rotatably mounted on the base carriage unit 12. The shaft 88 is connected to a wheel 90 which is adjacent to and in contact with the underside of the turntable 14. The shaft 88 and wheel 90 are rotatably mounted on the base carriage unit 12, and in the preferred embodiment are mounted substantially perpendicular to the longitudinal axis of the base carriage unit 12 and aligned with the center pivot shaft 78 of the turntable 14 such that a line extending along the longitudinal axis of the shaft 88 would intersect the center pivot shaft 78 of the turntable 14. As the manual crank 18 is rotated, the motion is translated by the connected belts 84*a* and 84*b* to the shaft 88 and wheel 90, which are then rotated. The rotation of the wheel 90 is translated to the turntable 14 by the direct contact of the wheel 90, and thus the turntable is rotated.

The power means for rotating the turntable 14 resides in the base carriage unit 12 and in the preferred embodiment consists of an electric motor 20 with a rotating shaft 92 extending from it. Mounted on the end of the rotating shaft 92 is a gear 80 with an angled face, mounted such that the rotational axis of the gear 80 is aligned with the rotational axis of the shaft 92 which intermeshes and is in contact with another gear 82 with a similarly angled face which is mounted on the center pivot shaft 78 of the turntable 14 such that the rotational axis of the gear 82 is in alignment with the rotational axis of the center pivot shaft 78. The gears 80 and 82 may be enclosed in a gearbox 94 if desired.

Figure 10:
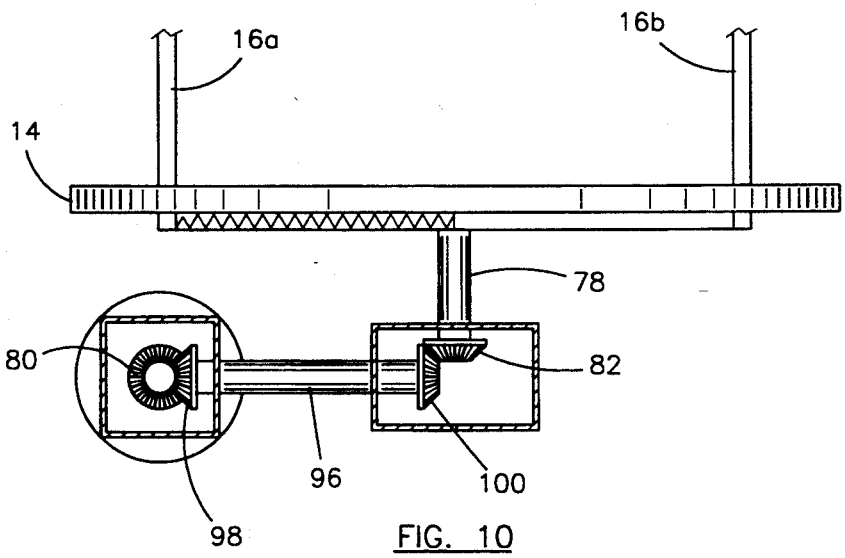
FIG. 10 is a partial detail side elevational view of the gearing means to rotate the turntable.

An alternative power means for rotation of the turntable 14 is shown in FIG. 10. This merely consists of substituting another rotatably mounted shaft 96 having gears 98 and 100 mounted at each end, in the same fashion as the gears 80 and 82 are mounted on their respective shafts 92 and 78, and intermeshing and in contact with the aforementioned gears 80 and 82. In this alternative, the main difference is the location of the electric motor 20, which can be placed in almost any location on the underside of the base carriage unit 12.

Figure 11:
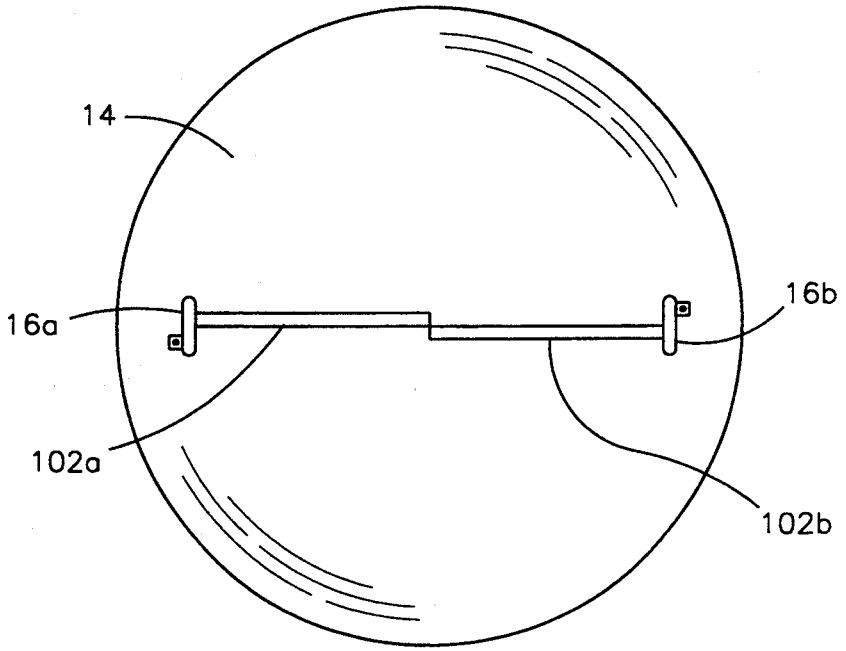
FIG. 11 is a detail top plan view of the turntable with the grip tongs mounted in tracks upon it.
Figure 12:
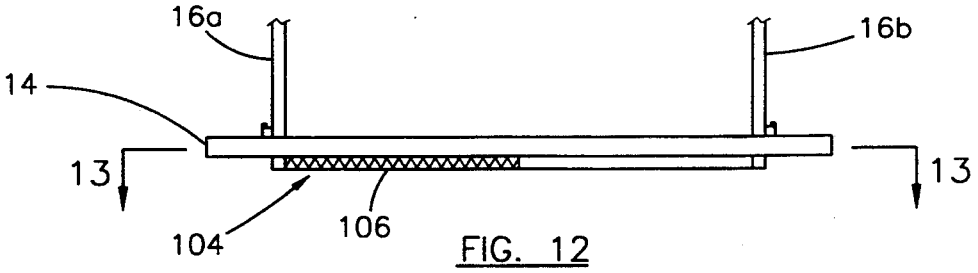
FIG. 12 is a partial detail side elevational view of the turntable showing the springs underneath the turntable which pull the grip tongs towards the center of the turntable.

FIGS. 11 and 12 are respectively top and side detail views of the turntable 14 and the grip tongs 16*a* and 16*b* movably mounted thereon. In the preferred embodiment, the grip tongs consist of a pair of substantially upright members movably mounted in a pair of tracks 102*a* and 102*b* in the turntable 14 extending outward from the center pivot shaft 78 in diametrically opposed relation. In the preferred embodiment, the tracks 102*a* and 102*b* extend to within 1" of the outer edge of the turntable 14 and consist of square U-shaped channels cut into the turntable 14.

Figure 13:
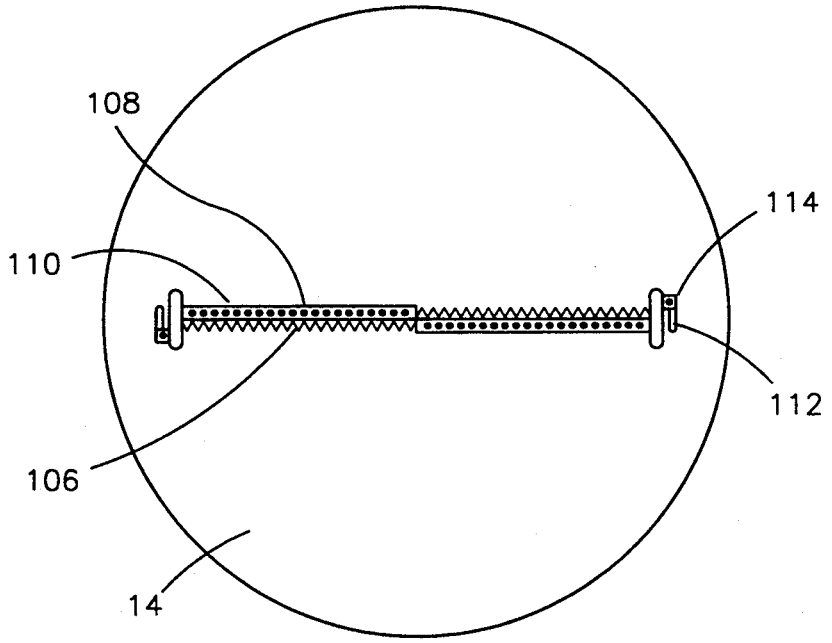
FIG. 13 is a top sectional view of the above mentioned tracks and springs, as seen on line 13—13 in FIG. 12.

As best shown in FIG. 13, in the base of each track 102*a* and 102*b* is a spring securing mechanism 104 to hold baggage more tightly between the grip tongs 16*a* and 16*b*. Preferably, the spring securing mechanism 104 consists of a spring 106 attached at one end to the center pivot shaft 78 and at the other to the base of the grip tong 16*a*. The spring 106 pulls the grip tong 16*a* towards the center pivot shaft, and as each grip tong 16*a* and 16*b* is pulled towards the center, baggage is secured between them. The other part of the spring mechanism is a length of flat steel 108 into which have been drilled a plurality of latch holes 110 in a line running along the longitudinal axis of the flat steel 108. Attached to the base of each grip tong 16*a* and 16*b* is a latch lever 112 which when pushed down, inserts a latch 114 into a receiving latch hole 110, whereby the grip tong 16*a* is held in place. As the same spring securing mechanism 104 is in place for both grip tongs 16*a* and 16*b*, when both grip tongs 16*a* and 16*b* are latched in place, baggage is secured therebetween.

Figure 15:
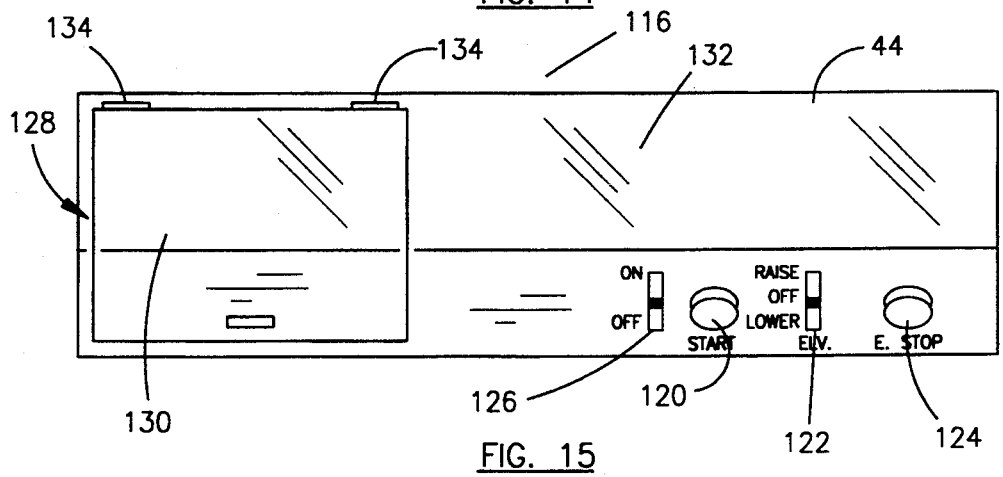
FIG. 15 is an enlarged top plan view of the control panel.
Figure 16:
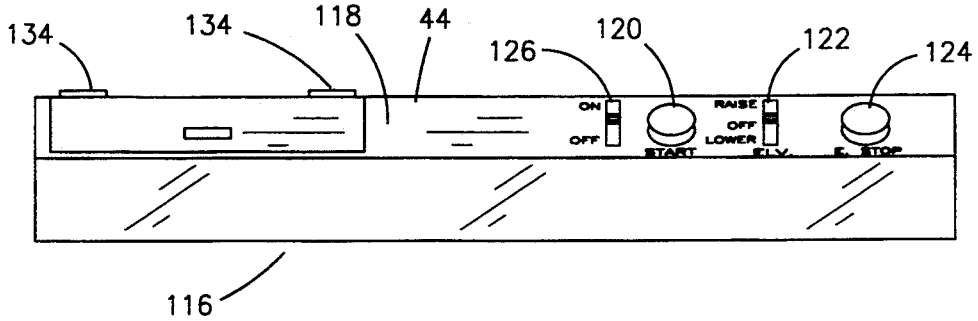
FIG. 16 is a rear elevational view of the control panel.
Figure 17:
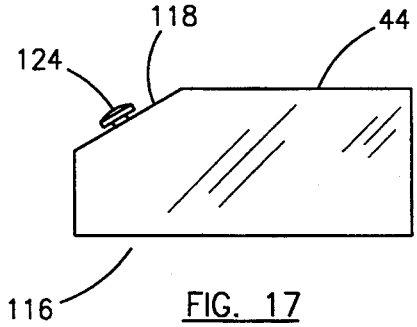
FIG. 17 is a side elevational view of the control panel.

FIGS. 15–17 show three detail views of the control panel 44, top, front, and side views respectively. In the preferred embodiment, the control panel consists of a rectangular box 116 in which, using FIG. 17 as a reference, the upper left corner is cut away and replaced with a angled panel 118. Looking at FIG. 15, on the right half of the rectangular box 116 set on the angled panel 118 are three control buttons or switches 120, 122, and 124 and an on/off switch 126. On the left half of the rectangular box 116 is a storage compartment 128 consisting of a rectangular cutout 130 section of the upper face 132 and the angled panel 118 of the rectangular box 116. To the edge of the cutout section 130 opposite the angle panel 118 is attached a hinge 134 which is connected on the other end of the hinge 134 to the rectangular box 116, as shown in FIG. 15. The rectangular cutout 130 is thus a pivoting lid for the storage compartment 128.

Figure 14:
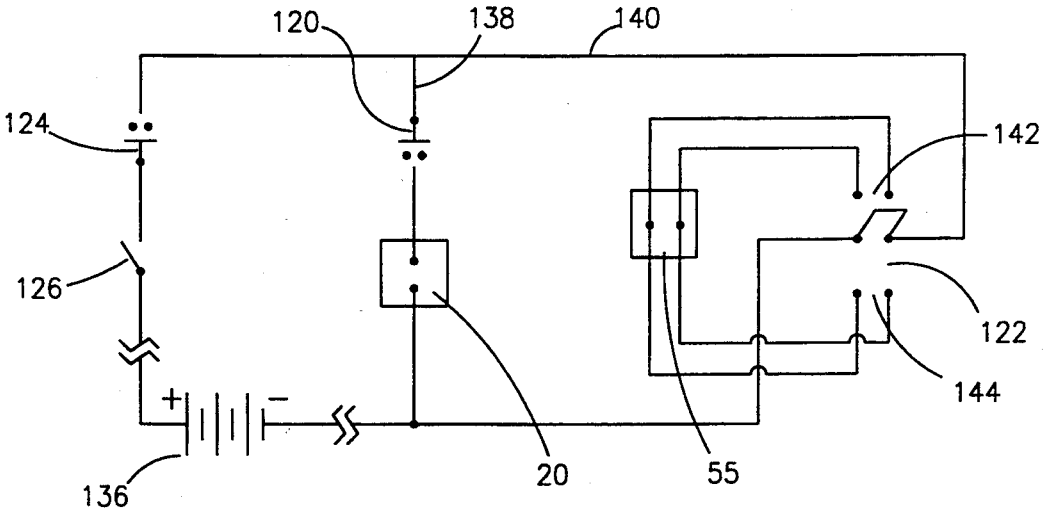
FIG. 14 is a schematic circuit diagram showing the circuitry of the baggage protection device.

The various controls for the baggage protection device 10 will now be described. The on/off switch 126 controls the flow of current to the other buttons or switches 120, 122 and 124 and electric motors 20 and 55. The circuit diagram is shown in FIG. 14. The other three control buttons or switches are respectively, the start/stop button 120 for the electric motor 20 that rotates the turntable 14, the start/stop for the electric motor 55 which elevates or lowers the movable platform 28, and the emergency stop button 124.

The start/stop button 120 for the turntable rotating electric motor 20 in the preferred embodiment is a standard push-button spring-return switch, which is pressed to start rotation of the turntable 14, and pressed again to stop the rotation.

The start/stop switch 122 for the movable platform electric motor 55 in the preferred embodiment is a three-position, two-pole switch mounted so that when the switch 122 is pushed up, the platform 28 is raised, when the switch 122 is pushed down, the platform 28 is lowered, and when the switch 122 is centered, the platform 28 is immobile.

Finally, the emergency stop switch 124 in the preferred embodiment is a standard push-button spring-return switch which when pressed cuts the flow of current from the power means 136 to the electric motors 20 and 55.

FIG. 16 exhibits a second embodiment of the control panel 44 which includes only the turnable start/stop button 120 and emergency stop switch 124. FIG. 16 thus shows a simplified version of the present invention not including the movable platform 28.

In the preferred embodiment, power is supplied either by batteries or by being plugged into a conventional outlet. Of course, whichever power source is used mandates the use of either alternating or direct current electric motors.

The schematic circuit diagram of FIG. 14 shows the electrical connections between the various buttons and switches, the power means, and the electric motors. The current runs from the power means 136 to the on/off switch 126. From the on/off switch the current runs to the emergency stop button 124, and from there the current splits, as the electric motors 20 and 55 are wired in parallel. The first branch 138 passes through the start/stop button 120 which then proceeds to the turntable rotating electric motor 20, then returns to the power means 136. The second branch 140 leads to the three-position switch 122 controlling the movable platform electric motor 55. When the switch 122 is in the up-closed position 142, current runs to the electric motor 55 and the platform 28 is raised. When the switch 122 is in the down-closed position 144, current runs to the electric motor 55 in the opposite direction, and the platform 28 is lowered. At center position, the switch 122 is off. Current then returns to the power means 136.

Figure 18:
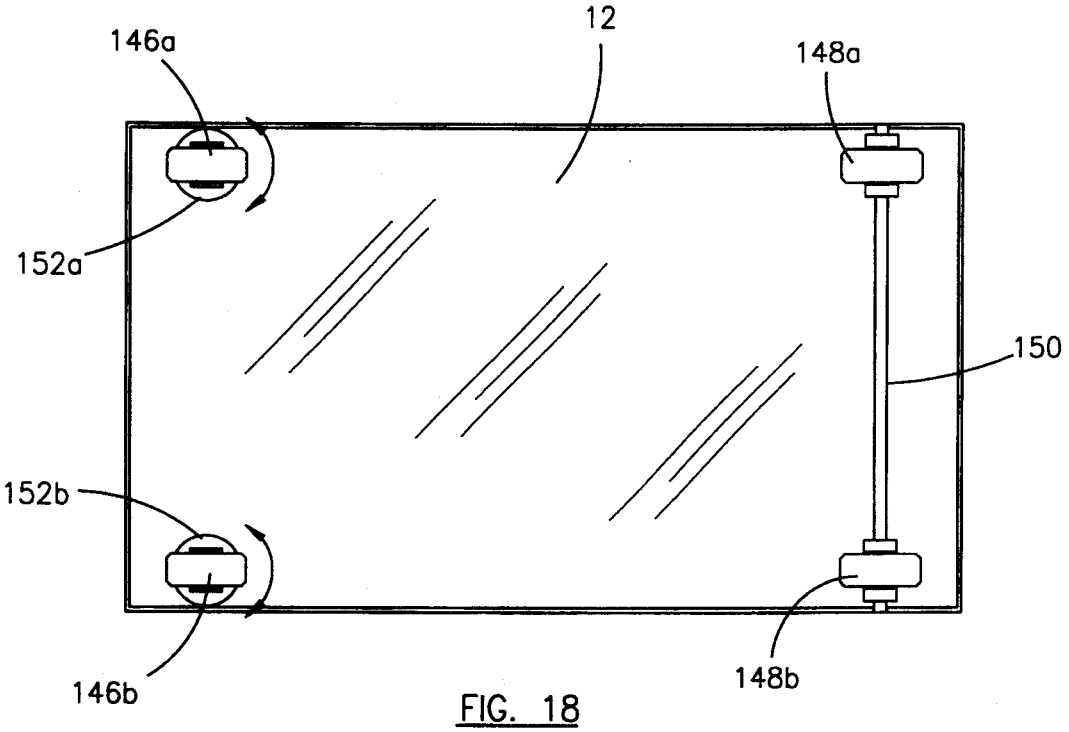
FIG. 18 is a bottom view of the carriage showing the location and range of motion of the wheels.
Figure 19:
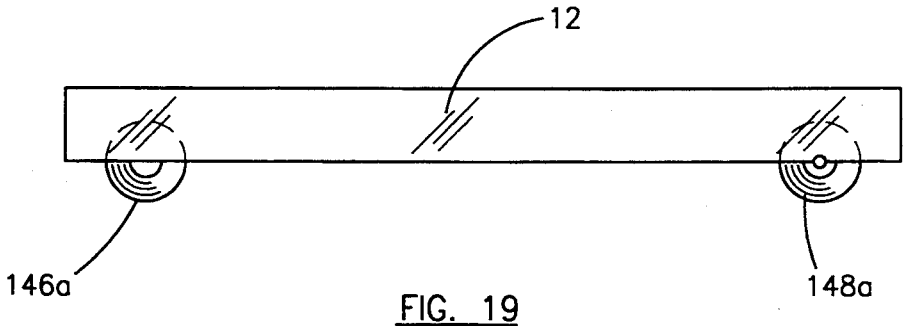
FIG. 19 is a side elevational view of the carriage.
Figure 20:
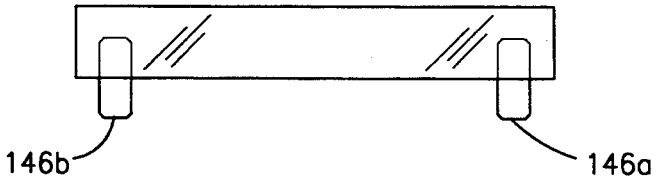
FIG. 20 is a front elevational view of the carriage.

Shown in FIGS. 18–20 are detail bottom, side, and front elevational views of the base carriage unit 12. In the preferred embodiment, 4 wheels 146*a* and 146*b* and 148*a* and 148*b* are used. The rear wheels 148*a* and 148*b* are rotatably mounted to the rear underside of the base carriage unit 12 on an axle 150 at opposite ends of the axle 150 and substantially perpendicular to the longitudinal axis of the base carriage unit 12. The front wheels 146*a* and 146*b* are rotatably mounted near the front of the underside of the base carriage unit 12, and on opposite sides of the longitudinal axis of the unit 12. The front wheels 146a and 246b are mounted on rotating casters, 152a and 152b which allow each wheel 146a and 146b to rotate independently about a generally upright axis.

An alternative embodiment of the baggage protection device 210 of the present invention is shown in FIGS. 21–32 as including a base carriage unit 212 divided into front and rear sections 226 and 228 respectively.

Figure 22:
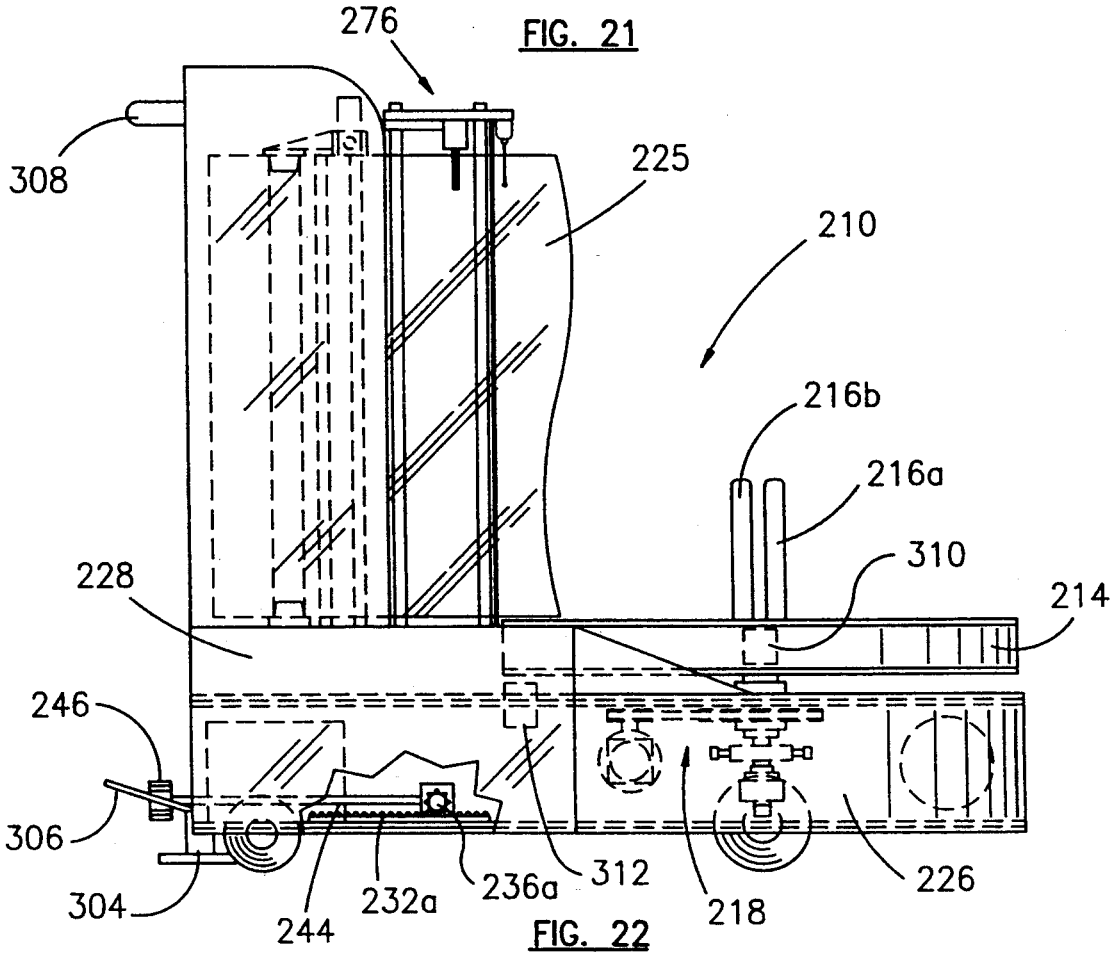
FIG. 22 is a side elevational view of the embodiment of FIG. 21 showing the front and rear sections of the base carriage in contact, i.e., the front section is not extended.
Figure 23:
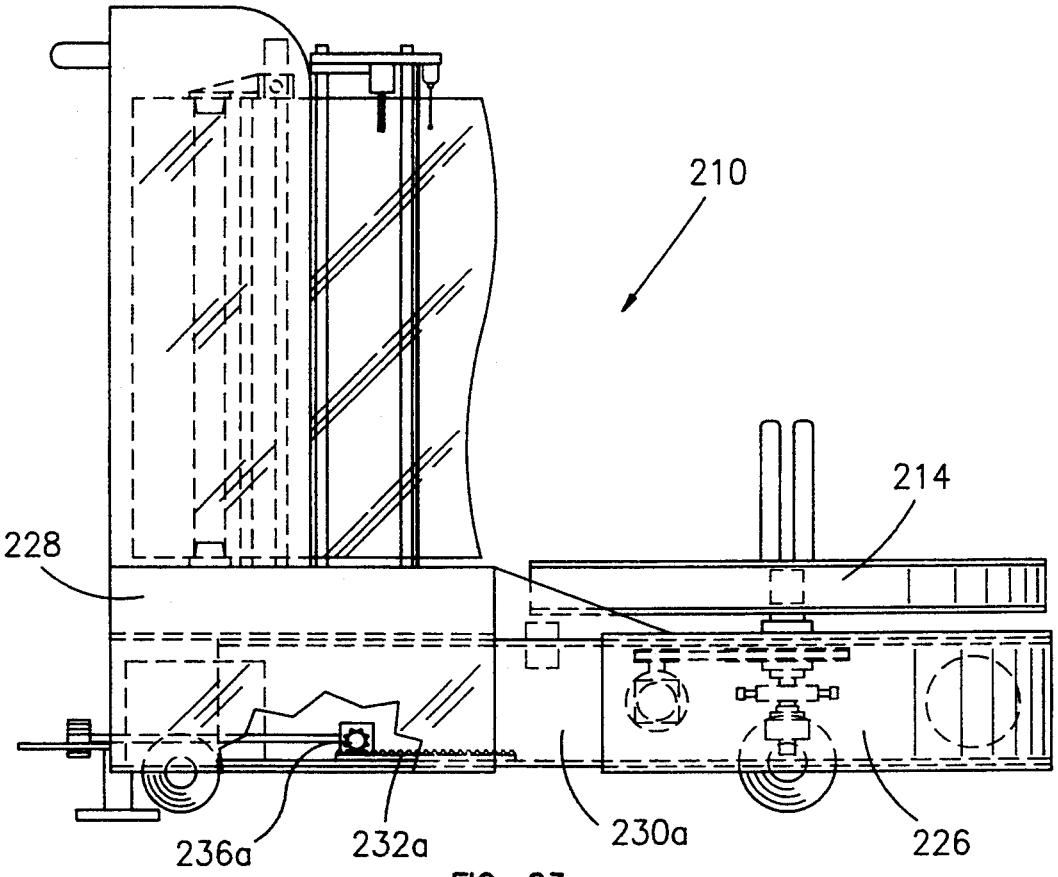
FIG. 23 is a side elevational view of the embodiment of FIG. 21 showing the base carriage in extended position for wrapping oversize luggage.

As shown in FIGS. 22 and 23, the front section 226 of the base carriage 212 is connected to the rear section 228 by a pair of rearwardly-extending extensions 230a and 230b which may slide within and be held by the rear section 228.

It is preferable that the extensions 230a and 230b be of sufficient thickness and width to prevent the base carriage unit 212 from bending in the middle when a heavy load is placed upon the base carriage unit 212. To this end, it is preferred that the extensions 230a and 230b each be constructed of a piece of C-channel each having a gear rack 232a and 232b mounted on the lower inside surface of each C-shaped extension 230a and 230b.

For providing impetus to extend the front section 226 outwardly from the rear section 228, a pinion gear system 234 is provided. The pinion gear system 234 includes a pair of pinion gears 236a and 236b mounted on a pinion axle 238. The pinion axle 238 is preferably mounted substantially perpendicular to the two gear racks 232a and 232b as shown most clearly in FIG. 24. The pinion gears 236a and 236b then are mounted on opposite ends of the pinion axle 238 such that the teeth on each of the pinion gears 236a and 236b mesh with one of the gear racks 232a and 232b respectively. Mounted concentrically on the pinion axle 238 is an bevel gear 240 which is engaged by a similar bevel gear 242 which is concentrically mounted on the end of a rotating shaft 244. The shaft 244 extends rearwardly from the pinion axle 238 and extends outside of the base carriage 212. Mounted on the outer end of the shaft 244 is a knob 246 which facilitates rotation of the shaft 244. Therefore, the front section 226 of the base carriage 212 may be extended by rotation of the knob 246 which in turn rotates the shaft 244 and thus the bevel gear 242. Rotation of the bevel gear 242 rotates the bevel gear 240 mounted on the pinion axle, thus rotating the pinion axle 238 and thus the pinion gears 236a and 236b mounted thereon. As the pinion gears 236a and 236b rotate, the gear racks 232a and 232b are moved forward or rearward depending upon the rotational motion of the pinion gears 236a and 236b. The C-channel extensions 230a and 230b thus are moved forward or rearward, thus extending or retracting the front section 226.

Figure 25:
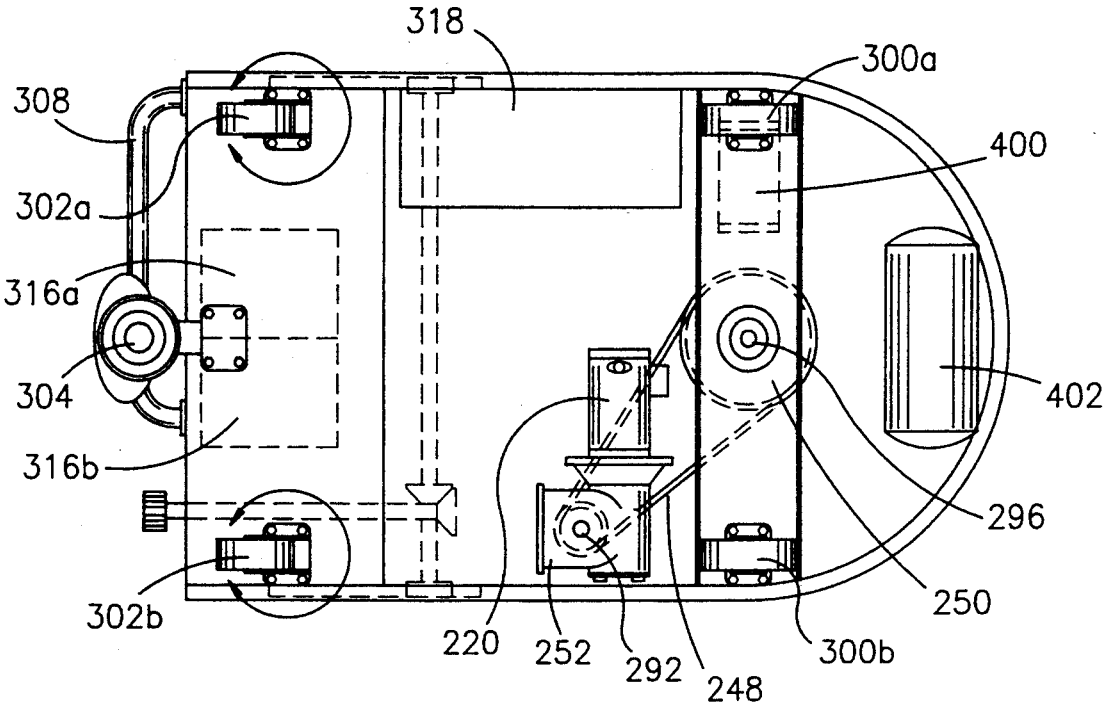
FIG. 25 is a bottom plan view of the embodiment of FIG. 21 showing the turntable drive mechanism and various undercarriage components.
Figure 30:
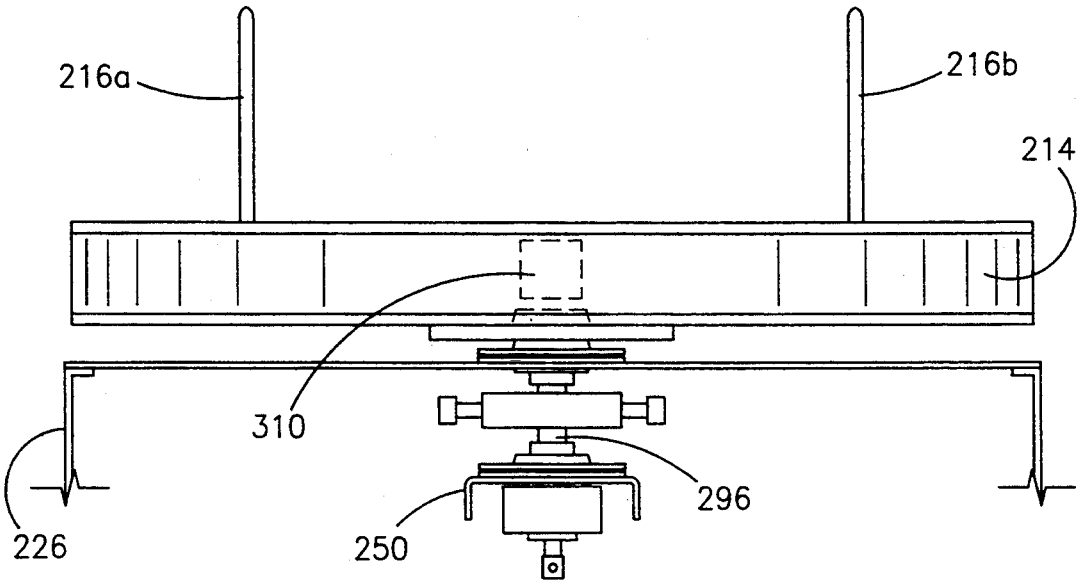
FIG. 30 is a front elevational sectional view of the embodiment of FIG. 21 showing the turntable and drive means for the turntable.
Figure 31:
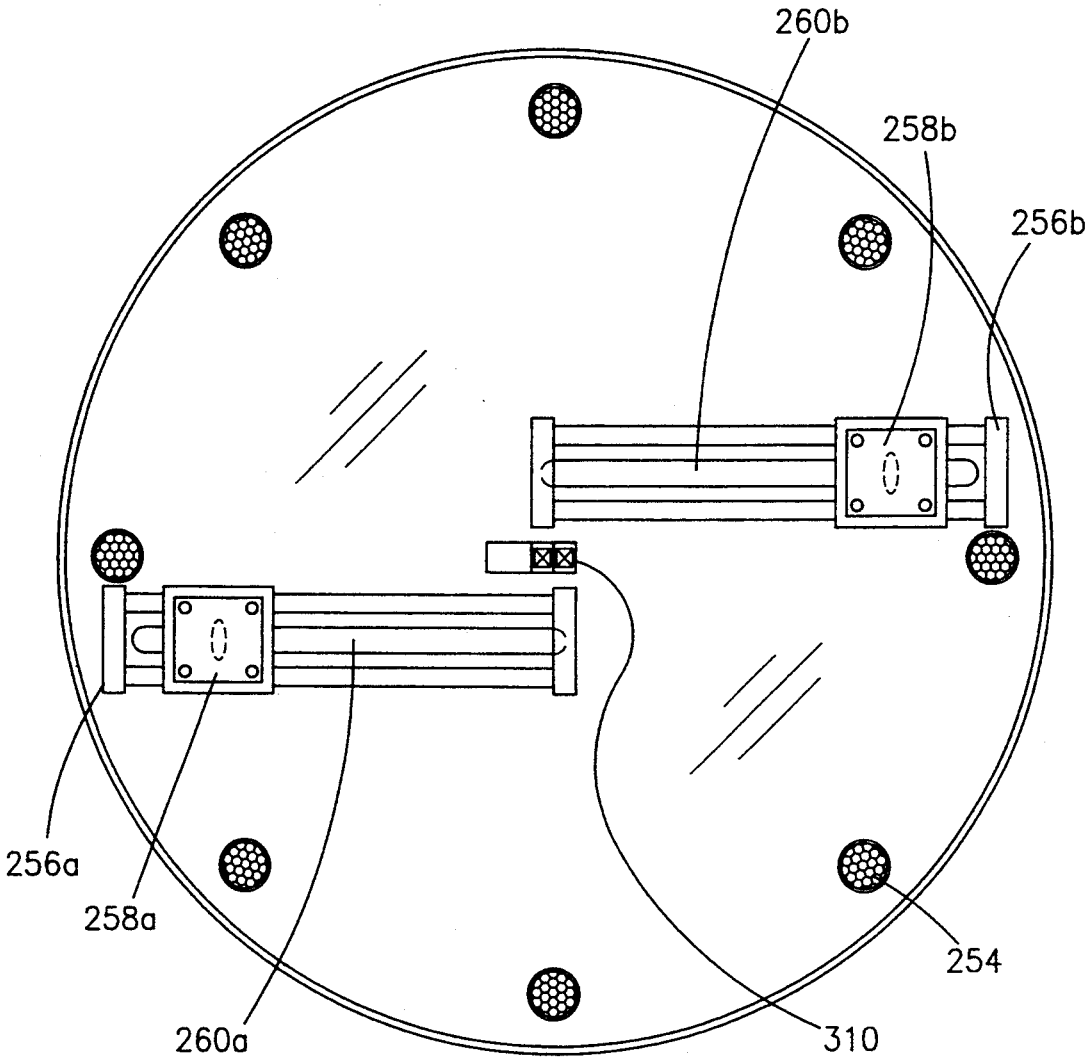
FIG. 31 is an enlarged bottom plan view of the embodiment of FIG. 21 showing the underside of the turntable including the reflector plates and rodless pistons mounted thereon.

Mounted on the front section 226 of the base carriage 212 is a turntable 214 on which are mounted a pair of grip tongs 216a and 216b. The turntable 214 and turntable rotation system 218 are best shown in FIGS. 25, 30 and 31. It is preferred that the turntable rotation system 218 consist of an electric motor 220 which is similar to that used in the first described embodiment. However, the gear connections of the first embodiment are replaced by a belt drive system in the present embodiment. The belt drive system consists of a belt 248 which extends between a gear box drive wheel 292 and a turntable drive wheel 250 which is concentrically mounted on the rotatably mounted turntable shaft 296. The gear box 252 is connected to the output shaft of the electric motor 220, thus allowing for slower, more controlled rotation of the turntable 214.

FIG. 31 exhibits the underside of the turntable 214. Mounted on the underside of the turntable 214 are a plurality of reflectors 254 spaced about the perimeter of the underside of the turntable 214. The reflectors 254 are preferably positioned at 45° intervals, although the spacing need only be uniform, and thus the exact number of reflectors used is not critical.

Also mounted on the underside of the turntable 214 are a pair of rodless cylinders 256a and 256b of the slider type, which means that each rodless cylinder 256a and 256b has thereon a slider 258a and 258b. The above features are elements of the securement system 255. As shown in FIG. 31, the rodless cylinders 256a and 256b are mounted generally parallel to one another. Each of the rodless cylinders 256a and 256b, furthermore, is mounted directly beneath a slot 260a and 260b formed in the top surface of the turntable 214. The slots 260a and 260b may be seen most clearly in FIGS. 21 and 24 as being substantially parallel and extending from adjacent the center point of the turntable 214 outward to adjacent the outer edge of the turntable 214. The slots 260a and 260b are slightly offset from a diameter of the turntable 214.

Figure 21:
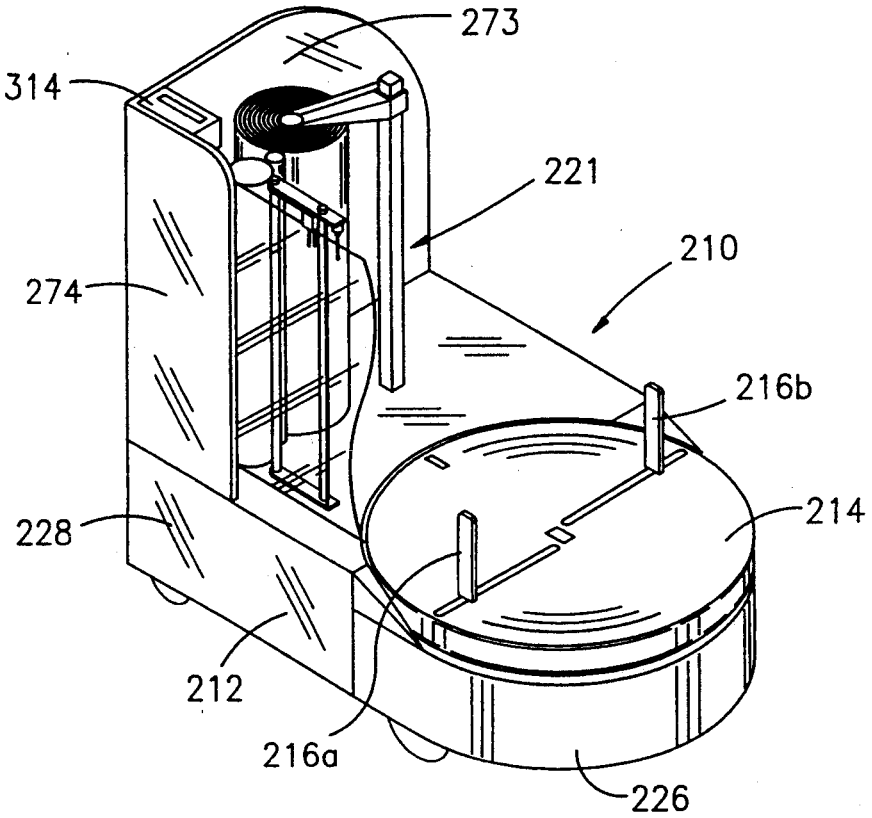
FIG. 21 is a perspective view of an alternative embodiment of the baggage protection device.

Extending through the slots 260a and 260b and mounted on the sliders 258a and 258b are a pair of grip tongs 216a and 216b, one grip tong mounted on each slider. Each grip tong 216a and 216b is preferably formed as shown in FIG. 21 as a rectangular piece of flat metal between 6" and 18" in height and 1–3" in width. Connection to each of the sliders 258a and 258b is preferably made by a pin formed to extend downwards from the base of the rectangular piece of flat metal which will extend into and be held by a slider 258a and 258b. For supplying compressed air to the rodless cylinders 256a and 256b to enable operation of the cylinders, an air compressor 400 is provided which will drive the cylinders 256a and 256b and thus open or close the grip tongs 216a and 216b as the sliders 258a and 258b move. For supplying air to the air compressor 400, an air tank 402 may be provided, the air tank 402 connected to the air compressor 400 by a hose (not shown). A piece of luggage may thus be secured between the grip tongs 216a and 216b as the grip tongs 216a and 216b are urged towards the center of the turntable 214. The grip tongs 216a and 216b then secure the baggage between them with sufficient holding force to prevent the baggage from movement on the turntable 214.

Mounted on the rear section 228 of the base carriage 212 is the plastic film dispensing assembly 221 which consists of a plastic roll holder 222 on which a roll of plastic film 224 may be mounted, an idler roller 262, a tensioning roller 264 and a cutting device 276. As is most clearly shown in FIGS. 24 and 28, the plastic film roll 224 is rotatably mounted about its central longitudinal axis such that plastic film 225 may be drawn from the plastic film roll 224. Plastic film 225 thus removed from the plastic film roll 224 passes around a rotatably mounted idler roller 262 which is preferably a substantially upright cylindrical roller. Mounted on the rear section 228 of the base carriage 212 adjacent the idler roller 262 is a tensioning roller 264, which preferably has a substantially larger diameter than the idler roller 262 and is in surface contact with the idler roller 262. Plastic film 225 passes between the idler roller 262 and the tensioning roller 264, around the tensioning roller 264 and forwards to the baggage to be wrapped. The tensioning roller 264 is mounted on a tension clutch 266, which is preferably a standard commercially available tension clutch. The tensioning roller 264 in combination with the tension clutch 266 provides the necessary tension to stretch-wrap the plastic film 225 around a piece of baggage.

Figure 29:
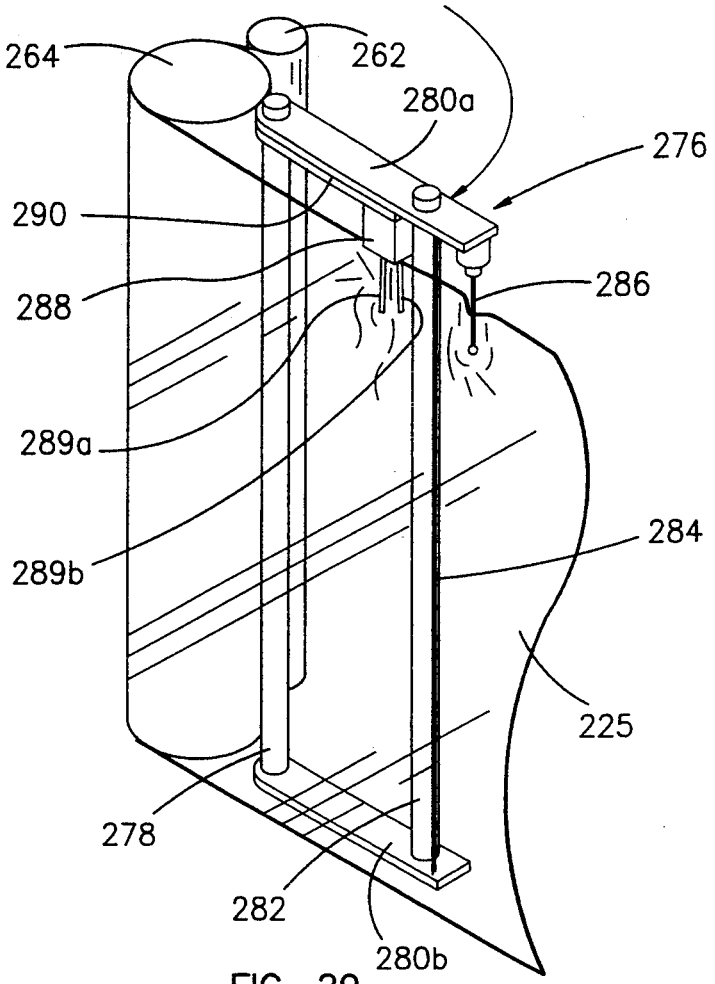
FIG. 29 is an enlarged perspective view of the tensioning roller, idler roller and cutting means of the present invention.

FIG. 29 most clearly shows the cutting device 276 of the present embodiment. The cutting device 276 includes a rotatably mounted vertical rod 278 to which are attached a pair of struts 280*a* and 280*b*, extending perpendicularly outward from the vertical rod 278, one mounted atop the vertical rod 278 and one mounted adjacent the base of the vertical rod 278. Extending between struts 280*a* and 280*b* is another vertical rod 282 which provides stability for the cutting device 276. The actual divisioning of the plastic is achieved by a hot wire cutter 284 mounted adjacent and parallel to the outer vertical rod to a 282. The hot wire cutter 284 divisions the plastic film 225 by contacting the film 225 and rapidly heating up thus divisioning the plastic film at the hot wire cutter 284 location.

The cutting device 276 may be rotated by any convenient means, but it is preferred that the vertical rod 278 be mounted on a small reversible electric motor (not shown) which may rotate the cutting device 276 upon engagement of the motor.

Mounted on the outer end of the upper strut 280*a* is a wobble lever actuated switch 286 which, when coming into contact with the plastic film 225, will signal that the cutting device 276 should stop rotating as the hot wire cutter 284 is now in contact with the plastic film 225. Before being divisioned, the plastic film 225 is gripped by a gripper 288 mounted on a strut 290 extending outward from the vertical rod 278, the strut 290 being substantially parallel with the top and bottom strut 280*a* and 280*b*. The gripper fingers 289*a* and 289*b* engage the plastic film 225 thus holding the plastic film 225 in place after it is divisioned by the hot wire cutter 284. The gripper 288 is preferably a fulcrum-type gripper such as an SMC Series MHC2-10D. After the plastic film 225 is divisioned, the cutting device 276 rotates back to its standby position, shown by the dotted lines in FIG. 28. The gripper strut 290 may be movably mounted on the vertical rod 278 such that the gripper 288 may be vertically adjusted to allow for engagement of varying widths of plastic film 225.

Figure 26:
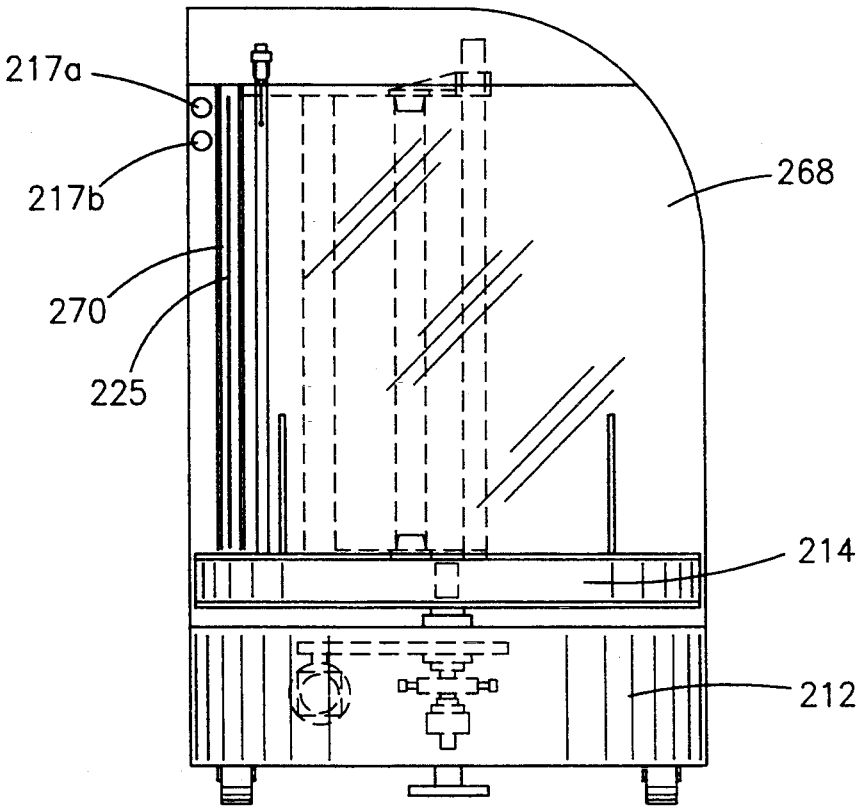
FIG. 26 is a front elevational view of the embodiment of FIG. 21.

The plastic film dispensing assembly 221, except for the cutting device 276, may be contained within a box-like structure 268, as shown in FIG. 26, which encloses the plastic roll holder 222, plastic film roll 224, idler roller 262 and tensioning roller 264. Plastic film 225 would then be dispensed through a slot 270 formed in the front face of the box-like structure. Access to the interior of a box-like structure 268 would then be through a door 272, shown in FIG. 27. Alternatively, the portable baggage wrapping device 210 may merely have a rear wall 273 and a side wall 274, as shown in FIG. 21.

Shown in FIG. 25 is the underside of the base carriage unit 212 which preferably includes a front set of wheels 300*a* and 300*b* and a rear set of wheels 302*a* and 302*b*. Contrary to the first embodiment, the rear wheels 302*a* and 302*b* are mounted on swivels, as shown in FIG. 25, which allow the device 210 to be easily moved between locations.

Figure 24:
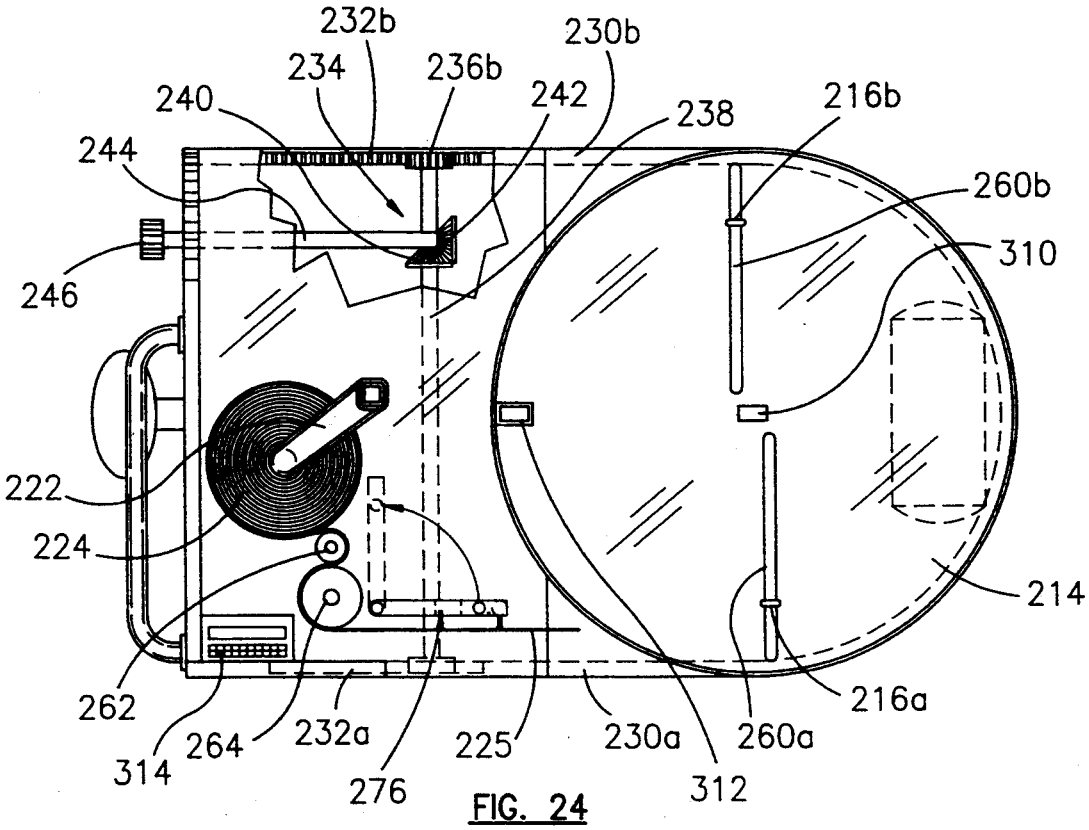
FIG. 24 is a top plan cutaway view showing the plastic film roll, idler roller and tensioning roller, and the gears and shafts which act to extend the forward section of the base carriage.
Figure 27:
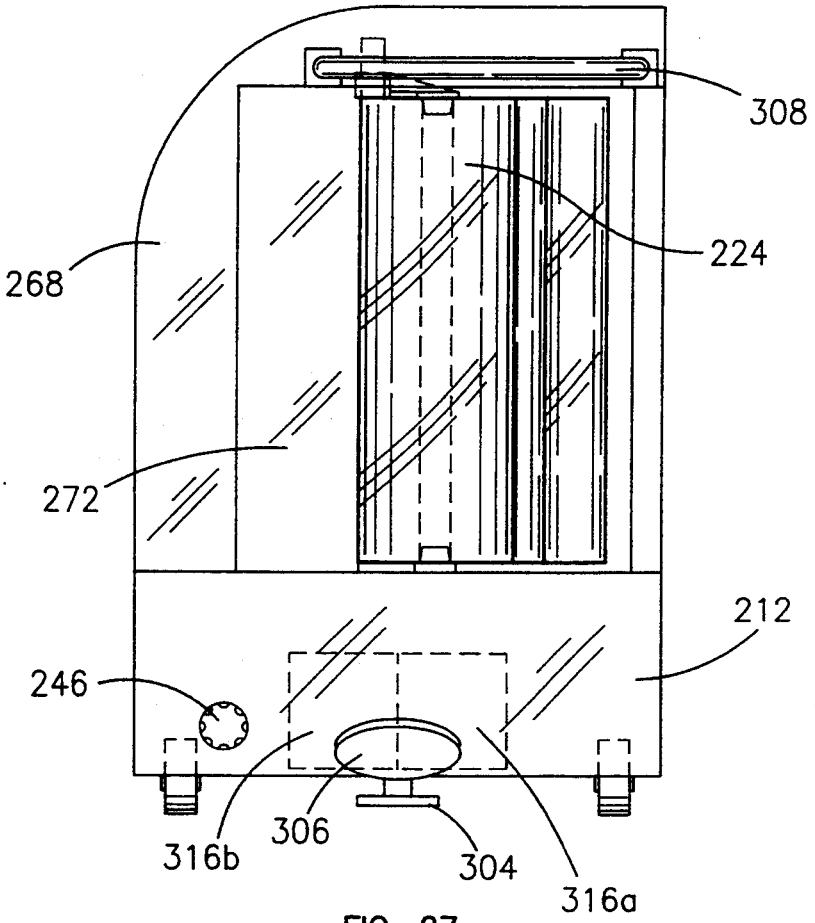
FIG. 27 is a rear elevational view of the embodiment of FIG. 21 showing the pancake cylinder and ground-engaging foot.
Figure 28:
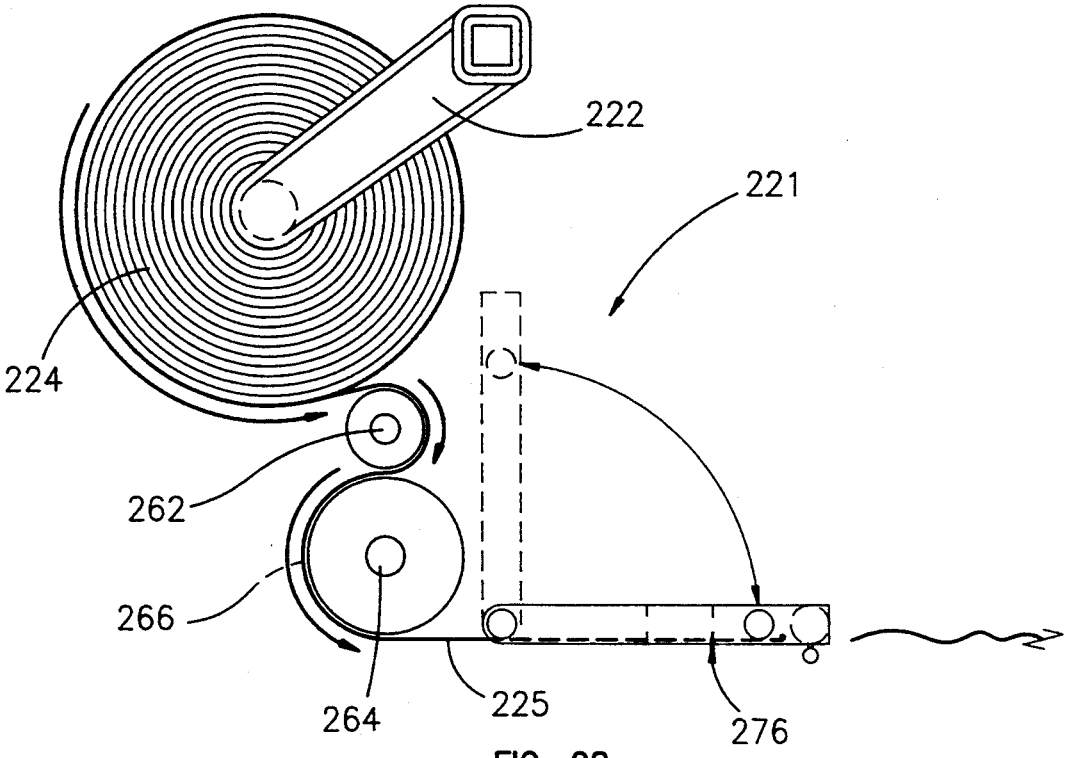
FIG. 28 is a top plan enlarged sectional view of the embodiment of FIG. 21 showing the plastic film roll, film being removed from the roll, passing over the idler roller, over the tensioning roller and pulled outward to be divisioned by the hot wire cutter.

Preferably mounted on the rear of the rear section 228 of the base carriage 212 is a hydraulic foot brake with a spring return 304. When engaged, the hydraulic foot brake 304 lifts the rear wheels 302*a* and 302*b* off of the ground to provide a more stable platform on which to wrap baggage. The hydraulic foot brake 304 may be engaged by pressing on a pedal 306 shown most clearly in FIG. 24. FIG. 24 also exhibits a handle 308 which may be used to propel the device 210 of the present invention. The handle 308 is preferably mounted on the rear wall 273, as shown in FIG. 27.

Mounted at the center point of a turntable 214 facing upwards is a photoeye #1 310 which is used to register the presence of baggage placed on the turntable 214. The photoeye #1 310 is shown in FIG. 21 as the small rectangular box in the center of the turntable 214, and as the dotted line box in the center of the turntable 214 in FIG. 22. Also shown clearly in FIG. 22 is photoeye #2 312 positioned underneath the turntable 214 and adjacent the outer edge of the turntable 214. Photoeye #2 312 keeps track of the number of reflectors 254 passing overhead as the turntable 214 rotates. The position of the turntable 214 thus may be kept track of at all times during rotation of the turntable 214.

Figure 32:
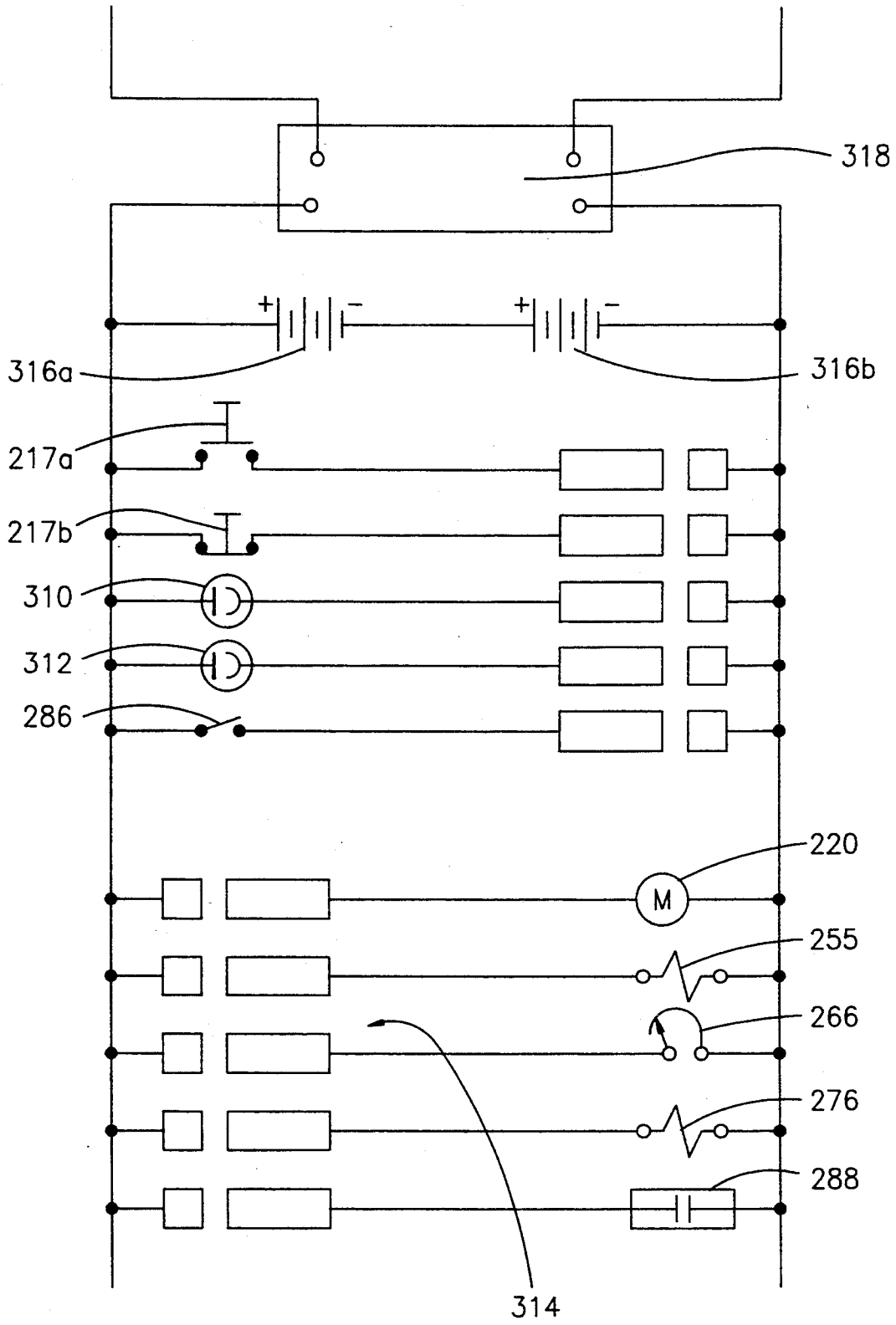
FIG. 32 is a ladder circuit diagram of the embodiment of FIG. 21 showing a simplified circuit diagram of the embodiment of FIG. 21.

For controlling all of the functions of the device 210, a programmable controller 314 is provided which is mounted on the rear and side walls 273 and 274 as shown in FIG. 21. The programmable controller 314 is preferably a microprogrammable controller such as the Micro-1 Micro Programmable Controller from IEC. FIG. 32 shows a ladder circuit diagram for the embodiment of the present invention exhibiting the various inputs and outputs of the programmable controller 314. As can be seen from FIG. 32, the start-stop buttons 217*a* and 217*b*, photoeye #1 310, photoeye #2 312 and the wobble lever actuated switch 286 comprise the inputs to the programmable controller 314. Based on these inputs, the programmable controller 314 outputs to the turntable motor 220, the securement system 255, the tension clutch 266, the cutting device 276 and the gripper 288. As one skilled in the art of working with such programmable controllers would be able to program such a controller to perform the desired operations, further explanation is not needed.

In operation, the device 210 preferably operates as follows: When baggage is placed upon the turntable 214, photoeye #1 310 acknowledges that the baggage is placed thereon and sends a signal to the programmable controller 314. The controller 314 sends a signal to the rodless cylinders 256*a* and 256*b*, engaging the cylinders and thus urging the grip tongs 216*a* and 216*b* towards the center of the turntable 214. The operator then pushes the start button 217*a*, which closes a contact to the programmable controller 314, which then sends a signal to start the turntable motor 220. Photoeye #2 312 counts the reflections as the reflectors 254 rotate past photoeye #2 312 and each time sends a signal to the programmable controller 314. The controller 314 counts the pulses from photoeye #2 312, sets the tension clutch 266 which provides tension for the plastic film 225, activates the hot wire preheat, which will enable the hot wire cutter 284 to division the plastic film 225 and then stops the turntable motor upon reaching a preset count of pulses from photoeye #2 312. The cutting device 276 is then rotated into its operating position, such rotation continuing until the wobble lever actuated switch 286 comes into contact with the plastic film 225, at which time the cutting device 276 stops rotation. The programmable controller 314 then engages the gripper 288 and then activates the hot wire cutter 284 divisioning the plastic film 225. After the baggage is removed from the turntable 214, photoeye

#1 310 registers that fact and signals the programmable controller 314 to reset all of the attached devices to ready status. The programmable controller may also maintain inventory of plastic film usage, operating hours, total cycle count, and numerous other housekeeping chores.

Finally, for providing power to run all of the devices described above, a pair of 12 volt batteries 316*a* and 316*b* may be provided as shown in FIG. 25 by the adjoining dotted rectangles adjacent the rear end of the rear section 228 of the base carriage 212. Alternatively, a power converter/charger 318 may be provided as shown in FIG. 25. The power converter/charger 318 would be capable of being plugged into any conventional wall socket to allow either operation of the device 210 or, alternatively, recharging of the batteries 316*a* and 316*b*.

It is noted that numerous modifications and variations of the present invention are possible in light of the above teachings. Therefore, it is understood that within the scope of the following claims, the invention may be practiced otherwise than as specifically described therein.

I claim:

1. A baggage protection device comprising:

a base carriage unit, said base carriage unit comprising front and rear sections, means for extendably connecting said front section to said rear section such that said front section may be extended from and retracted towards said rear section to accommodate oversized luggage for wrapping, a generally circular turntable having a center point and top and bottom faces, said turntable rotatably mounted in a substantially horizontal plane on said front section of said base carriage unit, securing means movably mounted on said turntable for securing baggage in substantially upright relation thereon, said securing means comprising a pair of grip tongs, said grip tongs comprising a pair of substantially upright members, said turntable further comprising one or more slots formed on said turntable, said grip tongs adapted to be movably mounted in at least one of said slots on said turntable, means for urging said grip tongs towards each other for securing baggage placed on said turntable between said tongs, means for rotating said turntable about a generally upright axis, means for removably mounting a generally stretchable moisture-impervious sheet material on said rear section of said base carriage unit in substantially upright relation generally parallel with said turntable axis, whereby said sheet material can be used to wrap baggage secured on said turntable, and means for dispensing said sheet material.

2. The baggage protection device of claim 1 wherein said means for extendably connecting said front section and said rear section further comprises a pair of rearwardly-extending extensions mounted on said front section, said extensions adapted to be slidably secured within said rear section.

3. The baggage protection device of claim 2 further comprising a rack and pinion gear system mounted in said rear section of said base carriage unit, said rack and pinion gear system operative to extend and retract said front section relative to said rear section.

4. The baggage protection device of claim 3 wherein said rack and pinion gear system further comprises a pair of racks, one mounted on each of said rearwardly-extending extensions, said racks mounted on said rearwardly-extending extensions such that said racks are within said rear section of said base carriage unit, and a pair of pinion gears, one contacting each rack, said pinion gears mounted on a pinion axle which may be rotated, thereby rotating said pinion gears and moving said racks, thereby extending or retracting said front section of said base carriage unit.

5. The baggage protection device of claim 1 wherein said means for urging said grip tongs towards each other comprises a pair of rodless cylinders mounted on said bottom face of said turntable, said rodless cylinders mounted substantially directly underneath and substantially parallel with said slots formed in said turntable.

6. The baggage protection device of claim 5 wherein said rodless cylinders further comprise one slider mounted on each of said cylinders such that said sliders may be moved along said rodless cylinders in response to said cylinders exerting force thereon.

7. The baggage protection device of claim 6 wherein said grip tongs further comprise one or more pins extending downwards from each of said grip tongs, said pins extending through said slots to be held by said sliders such that motion of said sliders results in motion of said grip tongs.

8. The baggage protection device of claim 5 wherein said rodless cylinders are operatively connected to an air compressor for supplying pressurized air to drive said rodless cylinders.

9. The baggage protection device of claim 1 wherein said generally stretchable moisture-impervious sheet material comprises a roll of stretch-wrap plastic film.

10. The baggage protection device of claim 9 wherein said means for dispensing said sheet material comprises a plastic film roll holder for rotatably supporting said plastic film roll, an idler roller and a tensioning roller whereby said plastic film may be stretched as it is being dispensed.

11. The baggage protection device of claim 10 wherein said idler roller further comprises a cylindrical roller having a center longitudinal axis rotatably mounted adjacent said plastic film roll holder, said idler roller mounted such that the center longitudinal axis of said idler roller is substantially upright, said idler roller rotating about said center longitudinal axis.

12. The baggage protection device of claim 10 wherein said tensioning roller further comprises a cylindrical roller having a center longitudinal axis rotatably mounted adjacent said idler roller and in contact therewith, said tensioning roller mounted such that the center longitudinal axis of said tensioning roller is substantially upright, said tensioning roller rotating about said center longitudinal axis.

13. The baggage protection device of claim 12 wherein said tensioning roller further comprises a tension clutch operative to retard rotation of said tensioning roller and thereby stretch said plastic film.

14. The baggage protection device of claim 1 further comprising a hot wire cutting device for divisioning said moisture-impervious sheet material.

15. The baggage protection device of claim 14 further comprising means for moving said hot wire cutting device between an operating position wherein said sheet material may be divisioned and a standby position.

16. The baggage protection device of claim 1 further comprising two photoeyes, one of said photoeyes mounted adjacent said center point of said turntable and facing upwards, the other of said photoeyes mounted beneath said turntable adjacent the periphery of said bottom face of said turntable and facing upwards.

17. The baggage protection device of claim 16 further comprising a programmable controller connected to said photoeyes, said means for rotating said turntable, said means for urging said grip tongs and said means for dispensing said sheet material for controlling overall operation of said baggage protection device.

18. A baggage protection device comprising:

a base carriage unit;

said base carriage unit comprising front and rear sections, means for extendably connecting said front section to said rear section such that said front section may be extended from and retracted towards said rear section to accommodate oversized luggage for wrapping, a generally circular turntable having a center point, said turntable rotatably mounted in a substantially horizontal plane on said front section of said base carriage unit, securing means movably mounted on said turntable for securing baggage in substantially upright relation thereon, said securing means comprising a pair of grip tongs, said grip tongs comprising a pair of substantially upright members, said turntable further comprising one or more slots formed on said turntable, said grip tongs adapted to be movably mounted in at least one of said slots on said turntable, means for urging said grip tongs towards each other for securing baggage placed on said turntable between said tongs, means for rotating said turntable about a generally upright turntable axis, means for removably mounting a generally stretchable moisture-impervious sheet material on said rear section of said base carriage unit in substantially upright relation generally parallel with said turntable axis, whereby said sheet material can be used to wrap baggage secured on said turntable, means for dispensing said sheet material, cutting means comprising a hot wire cutter for divisioning said moisture-impervious sheet material, and means for moving said cutting means between an operating position wherein said sheet material may be divisioned and a standby position.

19. A baggage protection device comprising:

a base carriage unit;

said base carriage unit comprising front and rear sections, means for extendably connecting said front section to said rear section such that said front section may be extended from and retracted towards said rear section to accommodate oversized luggage for wrapping, a generally circular turntable having a center point, said turntable rotatably mounted in a substantially horizontal plane on said front section of said base carriage unit, securing means movably mounted on said turntable for securing baggage in substantially upright relation thereon, said securing means comprising a pair of grip tongs, said grip tongs comprising two generally parallel substantially upright members, said turntable further comprising a track on a diameter of said turntable, said grip tongs adapted to be movably mounted in said track on said turntable, said track further comprising a spring tensioning device connected to said grip tongs such that each of said grip tongs are tensioned towards one another thus securing and centering baggage on said turntable when said grip tongs are in spaced apart relation, means for rotating said turntable about a generally upright turntable axis, means for removably mounting a generally stretchable moisture-impervious sheet material on said base carriage unit in substantially upright relation generally parallel with said turntable axis, whereby said sheet material can be used to wrap baggage secured on said turntable, three or more ground support wheels rotatably mounted on said base carriage unit, said rotating means for said turntable comprising an electric motor and gearbox combination whereby engagement of said motor results in rotation of said turntable, said generally stretchable moisture-impervious sheet material comprising a roll of stretch-wrap plastic film, said means for removably mounting said sheet material comprising a generally upright spindle mounted on said base carriage unit for removably rotatably supporting said roll of stretch-wrap plastic film, said spindle comprising a spring-tensioned shaft whereby tension is kept on said roll of plastic film thereby stretching said film as said baggage is encased in said film, a pair of feeder posts mounted on said base carriage unit in substantially upright and generally parallel relation, said feeder posts mounted between said plastic film roll holding spindle and said turntable and on opposite sides of the line formed between said spindle and said turntable axis, and a cutting means movably mounted on said base carriage unit whereby said sheet material may be divisioned.

* * * * *